United States Patent [19]

Fritz et al.

[11] 4,386,546

[45] Jun. 7, 1983

[54] PHASE LOCKING SYSTEM FOR AN ELECTRONIC ORGAN

[75] Inventors: Gary R. Fritz, Ferdinand; Stephen L. Howell, Huntingburg; John W. Robinson, Jasper, all of Ind.

[73] Assignee: Kimball International, Inc., Jasper, Ind.

[21] Appl. No.: 276,033

[22] Filed: Jun. 22, 1981

[51] Int. Cl.[3] ..... G10H 1/00

[52] U.S. Cl. ..... 84/1.01; 84/DIG. 4; 84/1.24

[58] Field of Search ..... 84/1.01, DIG. 4, 1.24, 84/1.03

[56] References Cited

U.S. PATENT DOCUMENTS

| | | | |
|---|---|---|---|
| 4,121,489 | 10/1978 | Adachi et al. | 84/1.24 |
| 4,186,637 | 2/1980 | Swain et al. | 84/1.01 |
| 4,215,616 | 8/1980 | Gross | 84/1.01 |

*Primary Examiner*—J. V. Truhe
*Assistant Examiner*—Forester W. Isen
*Attorney, Agent, or Firm*—Gust, Irish, Jeffers & Hoffman

[57] ABSTRACT

An electronic keyboard musical instrument comprising a multiplexed keyboard and a programmable microcomputer interfaced between the keyboard and a system of capture tone generators, and including means for causing phase locking between the tone generators. The loading circuitry for the microcomputer monitors the serial data stream and transmits only key change information to the microcomputer. The microcomputer controls the assignment and the assignment of tone generators for the accompaniment, solo and pedal manuals based on the key change information transmitted to it. In order to avoid cancellation between tones which are in octave or multiples thereof apart, the tone generators for each manual are phase locked with the other tone generators for that manual. Not only are the top octave synthesizers for each tone generator phase locked, but the divider strings are uniformly loaded so that they operate in identical states. The microcomputer phase locks one tone generator to another in accordance with a sequence dictated by its programming, and phase locking is accomplished regardless of whether the tones are initiated simultaneously or not.

25 Claims, 26 Drawing Figures

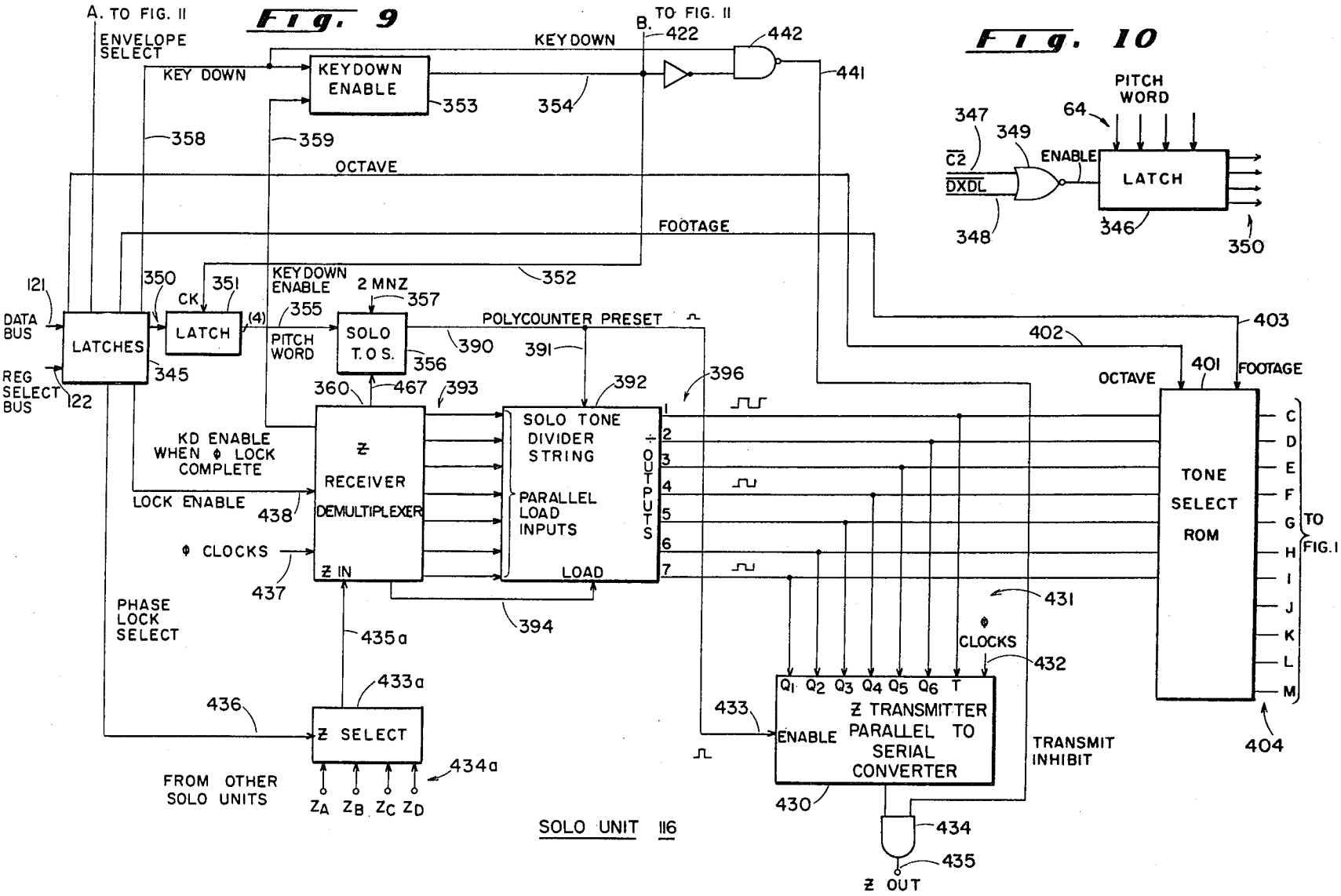
Fig. 10
PITCH WORD
LATCH
ENABLE
DXDL
C2
TONE SELECT ROM
FOOTAGE
OCTAVE
TO FIG. I
TRANSMIT INHIBIT
Z TRANSMITTER PARALLEL TO SERIAL CONVERTER
CLOCKS
ENABLE
Z OUT
Fig. 9
KEYDOWN ENABLE
KEY DOWN
ENVELOPE SELECT
A. TO FIG. II
B. TO FIG. II
KEYDOWN
OCTAVE
FOOTAGE
POLYCOUNTER PRESET
SOLO TONE DIVIDER STRING
PARALLEL LOAD INPUTS
LOAD
SOLO T.O.S.
2 MNZ
KEYDOWN ENABLE
PITCH WORD
LATCH
LATCHES
DATA BUS
REG SELECT BUS
Z RECEIVER DEMULTIPLEXER
Z IN
KD ENABLE WHEN Φ LOCK COMPLETE
LOCK ENABLE
Φ CLOCKS
PHASE LOCK SELECT
Z SELECT
FROM OTHER SOLO UNITS
SOLO UNIT 116

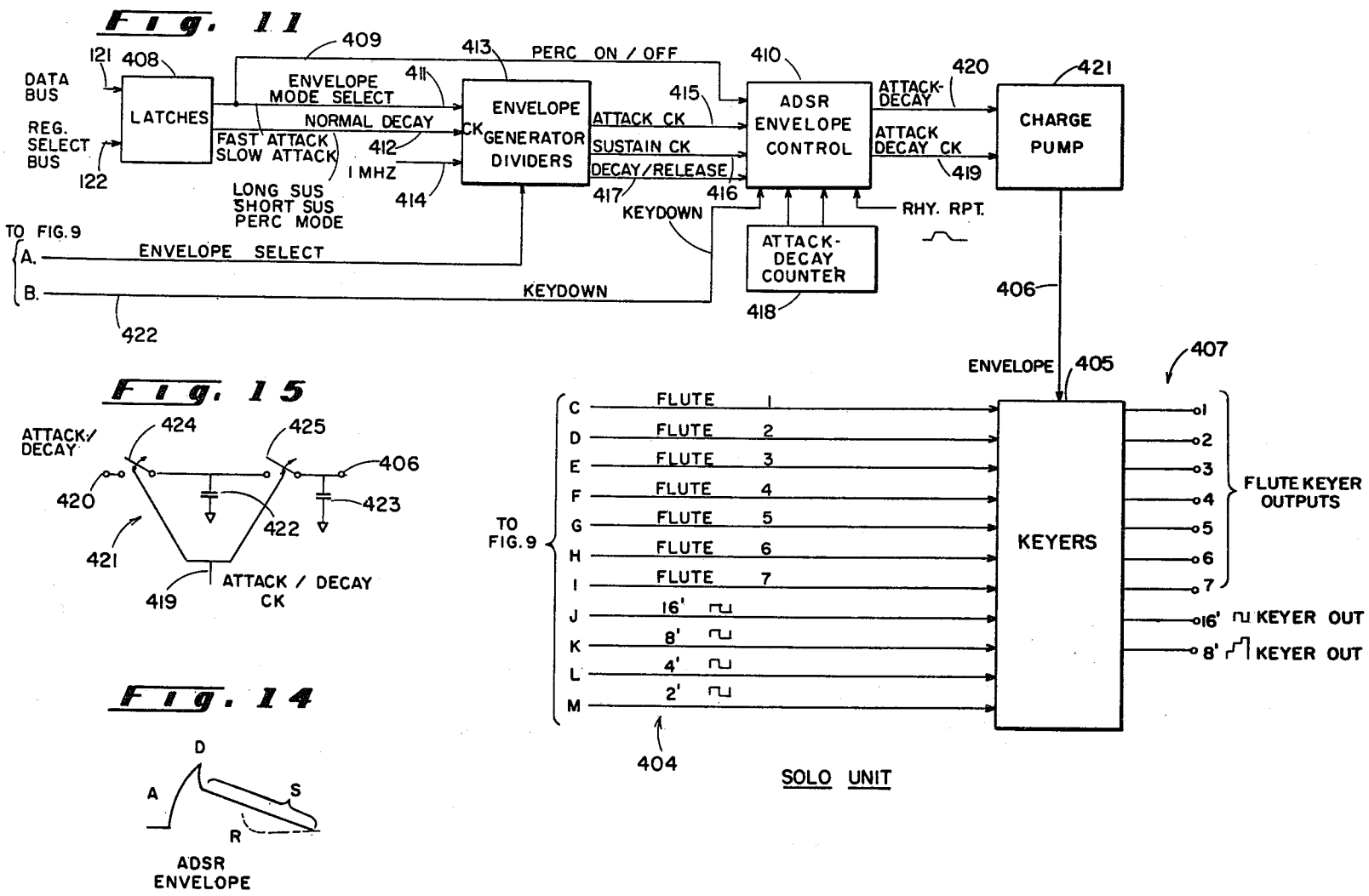
CHARGE PUMP
421
ADSR ENVELOPE CONTROL
410
ATTACK-DECAY COUNTER
418
ENVELOPE GENERATOR DIVIDERS
413
LATCHES
408
ENVELOPE MODE SELECT
409
ATTACK-DECAY
420
ATTACK DECAY CK
419
RHY. RPT.
ATTACK CK
415
SUSTAIN CK
416
DECAY/RELEASE
417
KEYDOWN
PERC ON / OFF
NORMAL DECAY
411
FAST ATTACK
SLOW ATTACK
412
1 MHZ
414
LONG SUS
SHORT SUS
PERC MODE
ENVELOPE SELECT
DATA BUS
121
REG. SELECT BUS
122
TO FIG. 9
A.
B.
422
406
ENVELOPE
405
KEYERS
407
FLUTE KEYER OUTPUTS
1
2
3
4
5
6
7
16'
8'
KEYER OUT
KEYER OUT
FLUTE 1
FLUTE 2
FLUTE 3
FLUTE 4
FLUTE 5
FLUTE 6
FLUTE 7
16'
8'
4'
2'
C
D
E
F
G
H
I
J
K
L
M
TO FIG. 9
404
SOLO UNIT
Fig. 11
Fig. 15
ATTACK/DECAY
420
424
425
406
423
422
421
419
ATTACK / DECAY CK
Fig. 14
A
D
S
R
ADSR ENVELOPE

TONE DIVIDER STRING

Fig. 16
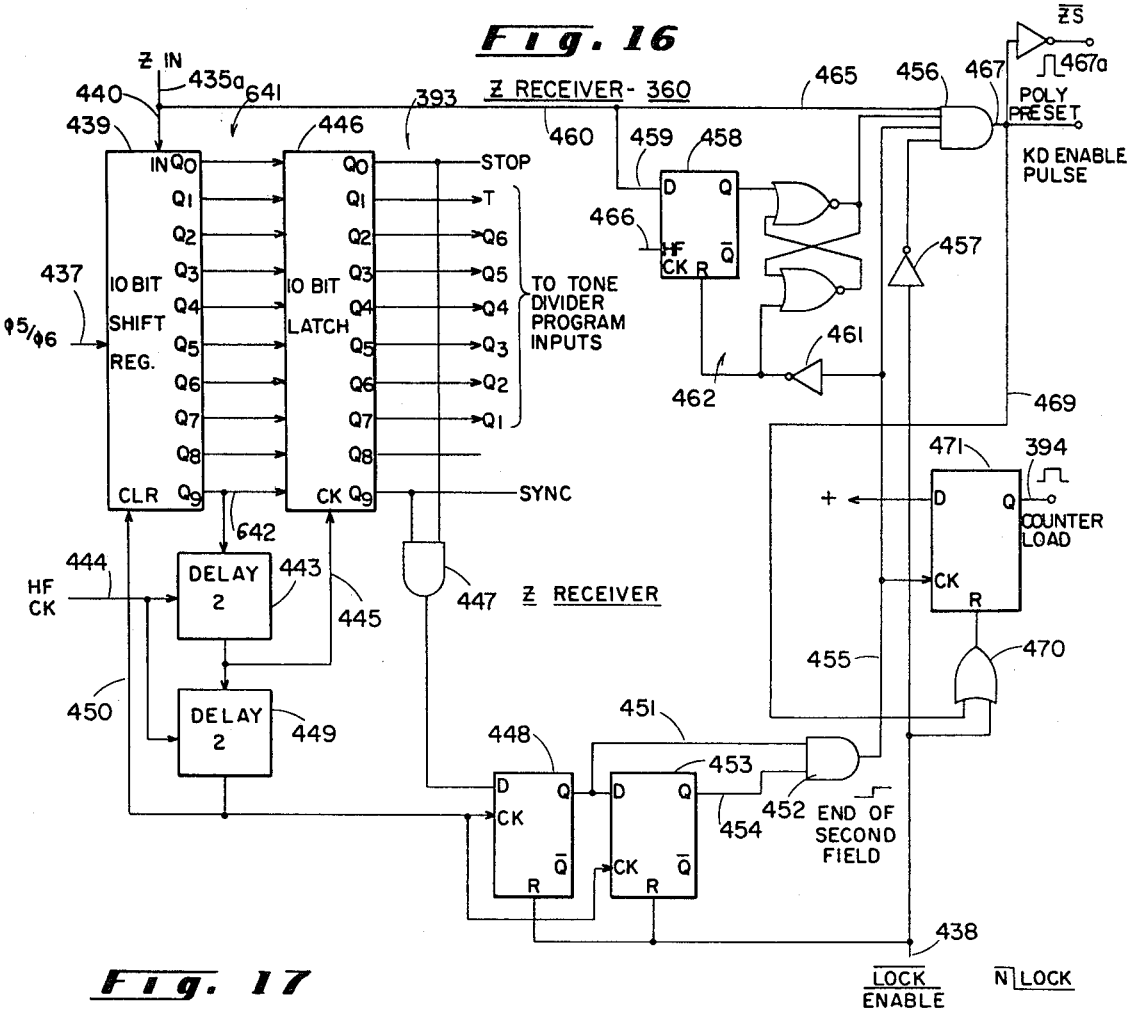
Fig. 17
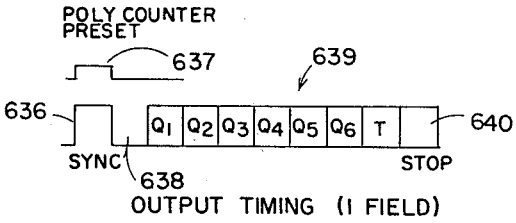
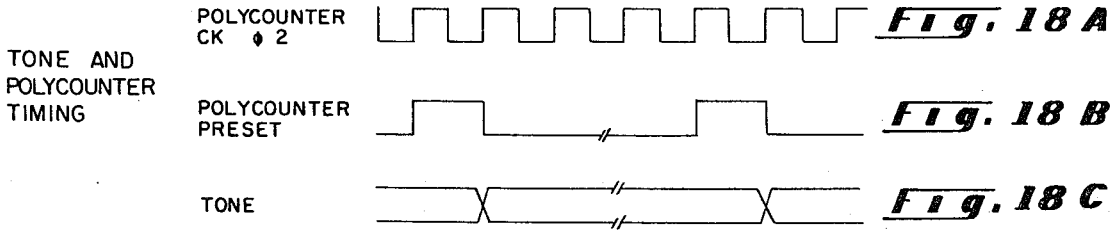
Fig. 18A
Fig. 18B
Fig. 18C

PHASE LOCKING SYSTEM FOR AN ELECTRONIC ORGAN

BACKGROUND OF THE INVENTION

The present invention relates to an electronic musical keyboard instrument, and in particular to such an instrument having capture-type tone generators and means for phase locking the tone generators to avoid phase cancellation of octavely related tones.

Earlier electronic musical instruments, such as electronic organs, employed discrete keyers connected between the tone generator and the output circuitry and have a control input on which a keying envelope appears when the key corresponding to that keyer is depressed. Although discrete keyer arrangements permt a very large number of tones to be simultaneously played, they are quite costly due to the large number of keyers which must be provided. For example, in a typical sixty-one note manual having the usual number of footages, a total of ninety-six different keyers are necessary for each rank, and the ranks must be duplicated for various instruments such as brass and percussion.

With the advent of large-scale integration techniques, a large number of keyers can be incorporated into a single chip thereby reducing the cost of the keyers and facilitating their incorporation into existing organ circuitry. Keyers of this type still have the drawback, however, that a given keyer is dedicated to a certain tone thereby rendering the system somewhat inflexible, and since the keyers are an integral part of the semiconductor chip, changes cannot easily be made without a major redesign of the chip.

Since there are only a small number of keys, generally twelve or less, which can be played at any one time, the vast majority of the keyers in a discrete system are idle so that the system has a great deal of redundancy built into it. Many years ago, it was recognized that a single keyer could be controlled to produce a wide variety of tones, and if enough of these tone generators are provided, then normal polyphonic playing can be accomplished.

A problem which arises with capture-type tone generator systems is that the phase relationship between the same pitch in different octaves, or the same pitch in the same octave, cannot be controlled as it can in more conventional tone generation systems wherein the master oscillators themselves can be phase locked, or wherein the divider strings are driven by the same tone. Because a capture-type tone generator produces the pitch independently of the other tone generators, the notes played by two of the tone generators that may be of the same or octavely related frequencies can be sounded 180° out of phase. This causes phase cancellation, which results in either a total loss of sound or a distorted sound, and is extremely undesirable from a musical standpoint. Even if the tones are not exactly 180° out of phase, partial phase cancellation will occur unless the two tones are locked exactly in phase.

In one prior art capture tone generator organ, phase cancellation is compensated for by detecting when two of the master generators produce tones that are octavely related, and then controlling a slave generator to generate the same note as played by one of the master generators. This results in three independent tone generators producing the two octavely related notes, and since all three generators cannot be 180° out of phase with each other, the possibility of total phase cancellation between octavely related notes is prevented. The drawback to this system is that a separate tone generator must be provided, thereby increasing the cost of the system. Moreover, it would seem that when two octavely related tones are played, the addition of the third tone generator producing one of them would result in a non-uniform sound as compared to the playing of two notes that are not octavely related. A further disadvantage is that the system does not compensate for partial phase cancellation, which can still occur to varying degrees even though a third tone generator is producing one of the notes.

A second type of phase locking system is used in synthesizers wherein two voltage controlled oscillators are activated by the depression of a single key on the keyboard. In this system, a synchronizing pulse is generated at the time that the key is depressed, and the tone generators are provided with a control input so that they start in the same phase in response to the synchronizing pulse.

SUMMARY OF THE INVENTION

The electronic organ according to the present invention comprises a plurality of tone generator-keyer units that are captured in response to the actuation of keys on the keyboard and are caused to produce respective tones having pitch and octave content corresponding to the depressed keys. Each of the tone generator-keyer units comprises a top octave synthesizer, such as a polynomial counter, driven by high frequency squarewave, and having an output connected to a programmable tone divider string. The polynomial counter is programmed so that it can produce tones of twelve different pitches depending on the pitch word transmitted to its inputs by the microcomputer-controlled assignment system interposed between it and the keyboard. The polynomial counter preset pulse, which is the tone output of the desired pitch, is connected to the input of the tone divider string, which divides the tone to produce a plurality of octavely related output tones. The output tones are connected to the inputs of a tone select ROM that selects one of the tones depending on an octave word also produced by the microcomputer.

With one of the capture tone generators running, the states of the divider string at a given time are converted into a serial data stream by a parallel to serial convertor, which data stream also includes a synchronizing pulse synchronized with the polynomial counter preset pulse of that tone generator. This serial data stream is transmitted to a serial to parallel convertor in one of the other captured tone generator units as determined by the microcomputer programming, and the data representative of the polynomial counter preset pulse and the divider string states is used to preset the polynomial counter in the second captured tone generator at the same time as the first-mentioned polynomial cunter, and to set identical states in the tone divider string of the second tone generator. This results in the two tone generators producing tones which are locked in phase because of the synchronization between the two polynomial counters and the divider strings.

Once the second tone generator has been locked in phase with the first, if a third tone generator is captured and requires phase locking, the same procedure is followed, and a third tone generator is locked in phase either to the first or second tone generator, depending on the programming of the microcomputer.

The advantage of the phase locking system of the present invention is that it does not require a separate tone generator as in the case of one of the prior art system described earlier. Furthermore, phase cancellation is prevented, rather than compensated for, by causing the tones to be precisely locked in phase. The phase locking system of the present invention can be used with any number of tone generators simply by programming the microcomputer to establish a phase locking sequence from one to the other, and since phase locking occurs very quickly, there is no noticeable lag in tone production from one tone generator to the other.

A further advantage is that, because the newly added tone generators are locked in phase before the tone is produced, there is no rapid shifting in phase of a tone generator already producing a tone. It is believed that this would produce musically undesirable effects.

Specifically, the present invention relates to an electronic musical instrument comprising a keyboard having playing keys, and a plurality of tone generator-keyers each capable of generating and keying a tone having a selectable frequency and a separate amplitude envelope. An assignment control system, such as one incorporating a programmable microcomputer, is connected to the tone generator-keyer units and is responsive to the actuation of keys of the keyboard to capture at least two of the tone generator-keyer units and cause the captured units to generate respective tones. A phase locking system is connected to the tone generator-keyer units for producing a synchronizing signal in response to the condition of one of the captured units, wherein the synchronizing signal bears a predetermined relation to the phase of the tone generated by the aforementioned captured tone generator unit. The phase locking system transmits the synchronizing signal to one of the other captured tone generator units, which includes means responsive to the synchronizing signal to cause the tone generated thereby to be in phase with the tone generated by the first-mentioned captured tone generator unit.

The tone generator unit preferaby comprises a tone generator and a divider string wherein the divider string includes a plurality of stages each capable of assuming one of at least two states. The phase locking system controls the tone generators of the captured units to generate the respective tones in phase with each other, and to set the corresponding stages of the divider means of the captured tone generator units in the same states, thereby enabling phase locking regardless of the octave relationship between the two tones.

It is an object of the present invention to provide an electronic musical instrument having a plurality of capture-type tone generators that are capable of producing a wide range of tones under the control of the actuation of keys of the keyboard, and wherein the tones produced by two or more of the captured tone generators can be locked in phase.

It is a further object of the present invention to provide such a phase locking system wherein the necessity for additional tone generator units to compensate for phase cancellation is avoided.

A still further object of the present invention is to provide a phase locking system for a capture-type tone generator system that is easily adaptable to a large number of tone generators.

These and other objects of the present invention will become apparent from the detailed description considered together with the appropriate drawing figures.

BRIEF DESCRIPTION OF THE DRAWINGS

FIG. 9 is a block diagram of one of the solo keyer/-tone generator units;

FIG. 10 is a schematic of the gating for one of the latches in the solo unit;

FIG. 11 is a block diagram of a portion of the solo unit;

FIG. 14 is a wave form diagram of a typical ADSR envelope;

FIG. 15 is a diagrammatic illustration of the charge pump of FIG. 11;

FIG. 16 is a schematic of the phase locking receiver;

FIG. 17 is a timing diagram for the phase locking system;

FIGS. 18A, 18B and 18C are timing diagrams for the top octave synthesizer;

DETAILED DESCRIPTION OF A PREFERRED EMBODIMENT

Figure 1A:
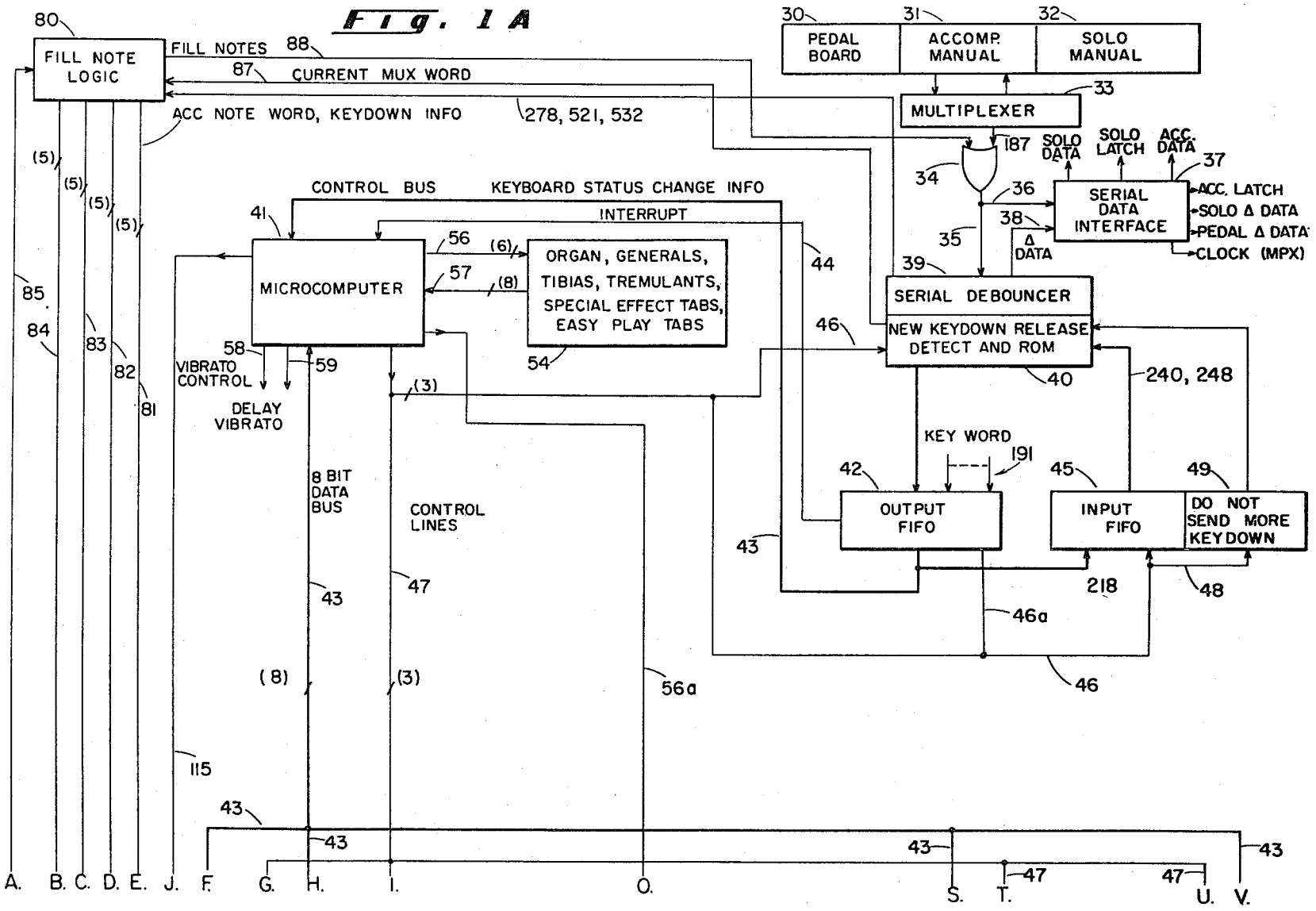
FIGS. 1A, 1B and 1C together are a block diagram of the organ incorporating the present invention.
Figure 1B:
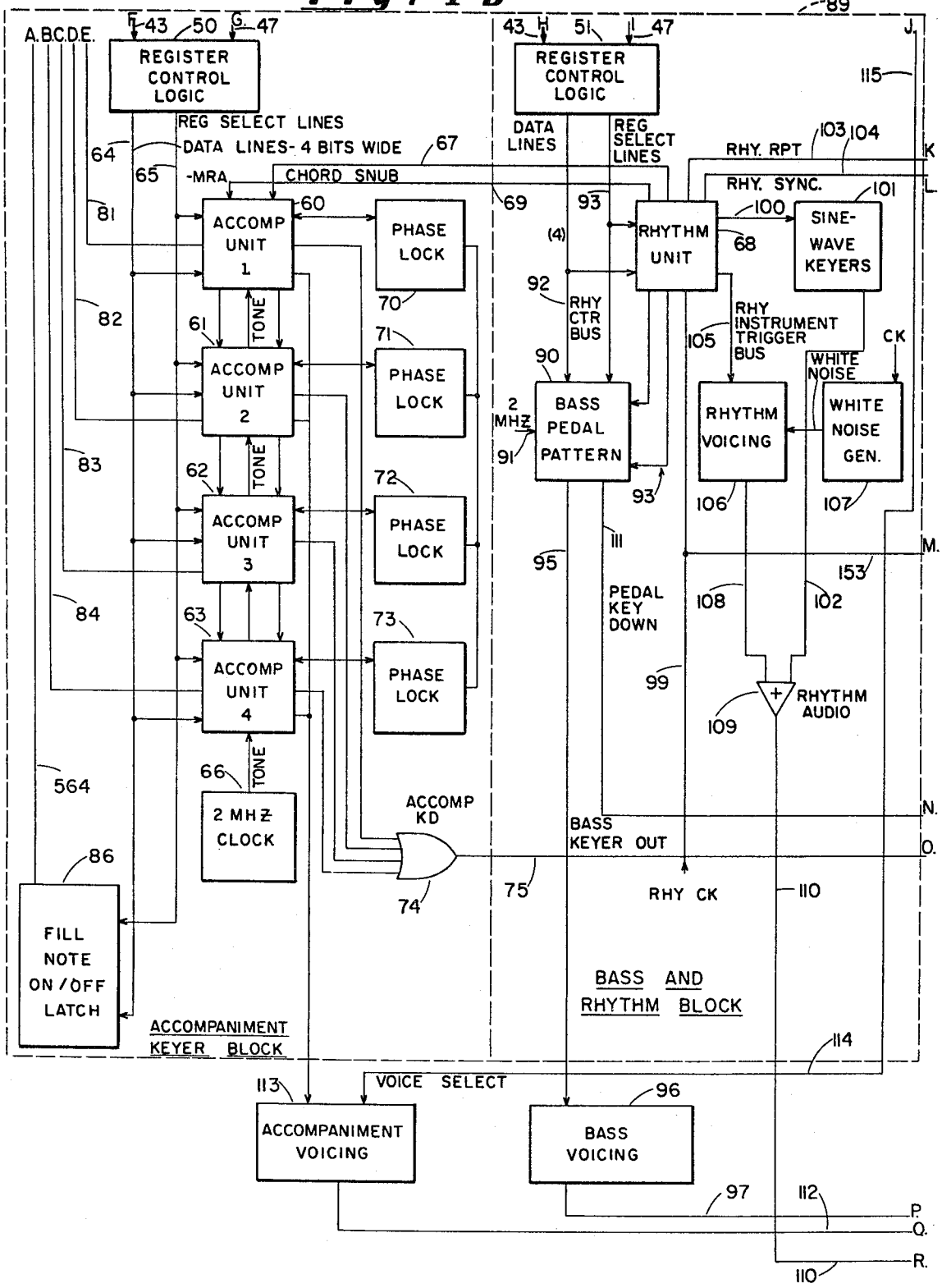
Figure 1C:
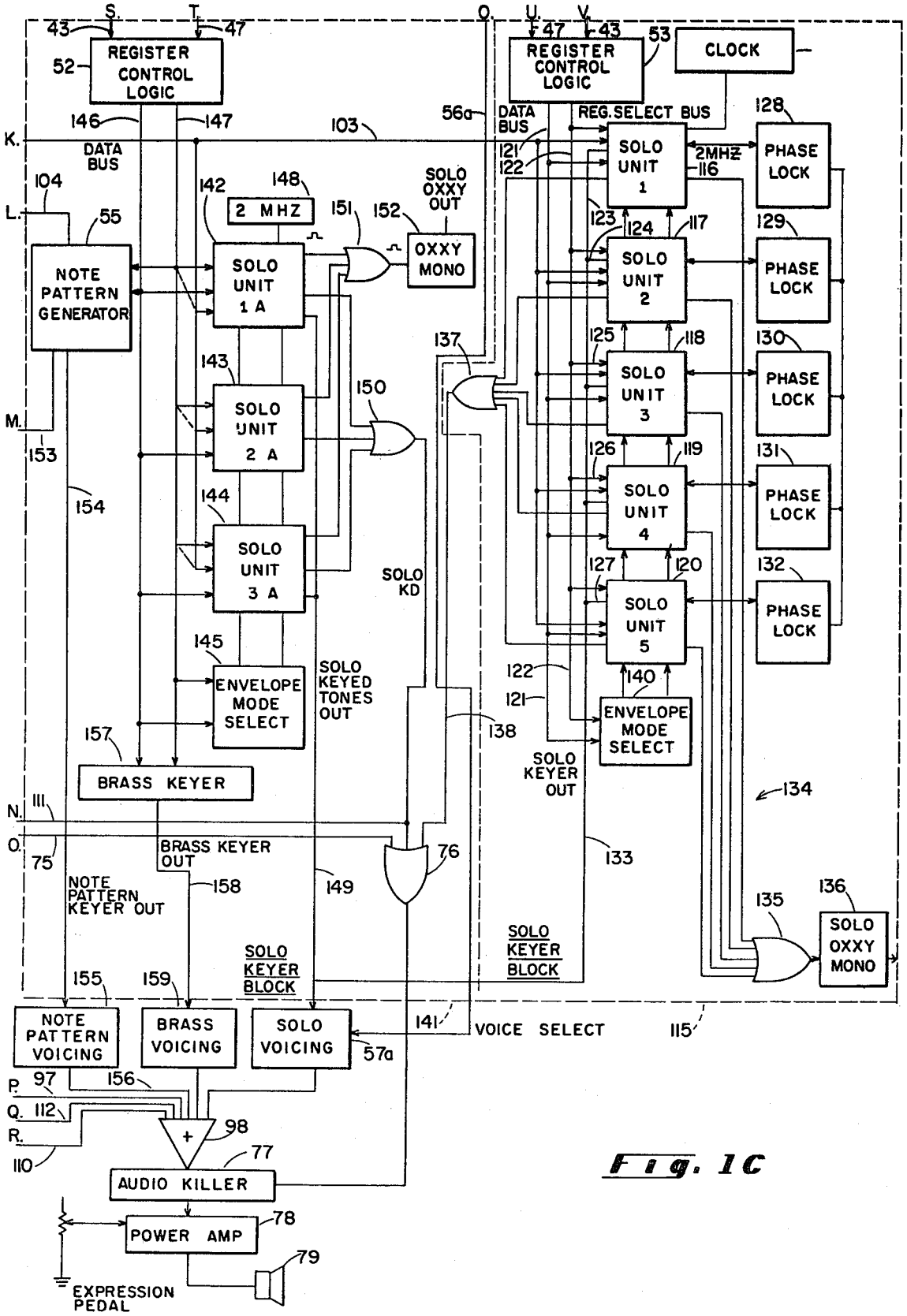

Referring now in detail to the drawings, and in particular to FIGS. 1A, 1B and 1C, the electronic organ according to the present invention comprises a conventional pedalboard 30, an accompaniment manual 31 and a solo manual 32 which are scanned in succession beginning with the solo manual and the keys of each manual are scanned from high to low by multiplexer 33. The output from multiplexer 33 passes through OR gate 34 onto serial data lines 35 and 36. As is conventional, the serial data stream comprises a plurality of time slots correponding to the pedals of pedalboard 30 and the keys of manuals 31 and 32, wherein pulses appear in time slots corresponding to depressed keys or pedals. The serial data interface block 37 has the serial data on line 36 as one input and a delta data pulse on line 38 as its other input. The delta data pulse is produced by serial debouncer 39 and is a pulse which occurs each time a new key not already held down is depressed. Delta data pulses have been used for many years in electronic organs and the circuitry for producing them will not be described for that reason. Serial data interface 37 is an optional block which permits the serial data to be interfaced with conventional multiplexed organ circuitry, if desired. As indicated, the outputs from block 37 are the solo data stream, the solo latch command occurring at the end of the scan of the solo manual 32, the accompaniment serial data, the accompaniment latch command, the solo delta data pulse, the pedal delta data pulse, and the multiplex clock.

Serial debouncer 39 debounces the serial data on line 35 and operates in synchronism with multiplexer 33. Debouncer 39 interprets a keydown pulse from the multiplexer 33 as being a valid signal on the leading edge of that signal and then monitors a period of non-bouncing key status for four scans of the manual. If the data reoccurs for four scans, debouncer 39 is enabled to process release of that key when it occurs. Debouncer 39 also monitors the data stream for key releases and processes this as valid data on the leading edge of that signal and then monitors a period of non-bouncing key status for fifteen scans of the manual. If the data does not reoccur in those fifteen scans, debouncer 39 is enabled to process keydown of that key when it occurs. Serial data debouncers have been utilized extensively in both the electronic organ industry and other fields.

The new keydown and release detect block 40 receives the debounced serial data from debouncer 39 and remembers what the last information sent to the microcomputer 41 was for each key in the serial data stream. When the new key detect block 40 sees a different state for a given time slot of the data stream from debouncer 39, it attempts to send this change of information to microcomputer 41. So whenever there has been a change in keyboard information block 40 will attempt to load this data into the output FIFO 42, which is a timing buffer which buffers the rate of multiplexer 33 with the speed of the microcomputer 41. FIFO 42 sends an interrupt signal to the microcomputer 41 whenever there is something in the buffer which is to be sent to the microcomputer 41. The key change information from FIFO 42 is connected to microcomputer 41 over an eight bit parallel bus 43, and the interrupt signal mentioned earlier is connected to microcomputer 41 over line 44. When the microcomputer 41 is free to process the interrupt signal, then it controls output FIFO 42 over lines 46*a* to output the key change word on the eight bit bus 43. If there is no keyer available, microcomputer 41 controls the output FIFO to place the word on the input FIFO 45, which is capable of storing six key changes. Input FIFO 45 connects to an input of the keydown and release detector 40, and has an input connected by lines 46 to the control lines 47 from the output of microcomputer 41. This output is also connected by line 48 to the input of a block 49 that signals the new keydown and release block 40 that the keyers are all busy for that manual and no new data should be sent until a keyer becomes available.

Microcomputer 41 is a commercially available 4K 3870 microcomputer manufactured by Mostek and other manufacturers. As indicated earlier, microcomputer 41 receives the keychange information from output FIFO 42 over a bidirectional data bus 43, which is eight bits wide, and which is capable of carrying data in both directions under the control of microcomputer 41. Although bus 43 has been shown as two separate groups of lines in FIG. 1A for the sake of clarity, it is actually a single bus serving as both an input and output to microcomputer 41.

Every time a keydown change is processed by new keydown release and detect block 40, which converts the serial data information to a binary word through a lookup ROM scanned in synchronism with multiplexer 33, output FIFO 42 transmits an interrupt signal to microcomputer 41 over control line 44. The key related data transmitted to microcomputer 41 is either a new keydown signal, a key release signal or a no key depressed signal indicating that no keys in a particular manual is actuated. This data, which is coded to pertain to a particular key in a particular keyboard 30, 31 and 32, is transmitted to microcomputer 41 over bus 43 when microcomputer 41 indicates that it is ready to receive the data. The received key information is in the form of an eight bit word. Microcomputer 41 maintains an internal list of which keyers are available, for the solo, pedal and accompaniment manuals, transmits assignments of the keyers, releases the keyers and reassigns keyers depending on their availability. The data for this assignment, deassignment and reassignment is transmitted over bus 43 to register control logic blocks 50, 51, 52 and 53 (FIGS. 1B and 1C) for the accompaniment, bass and solo units. Actually, the data is transmitted in two eight bit words which include also the steering information to select the proper logic control block 50, 51, 52 and 53. Control lines 47 from microcomputer 41 are also connected to register control logic blocks 50, 51, 52 and 53, and the data thereon controls the timing of the register control logic blocks while communicating with the microcomputer 41. All of the data is transmitted out via the eight bit bus 43 and processed by the register control logic blocks 50, 51, 52 and 53 and steered from there to the appropriate circuit.

The microcomputer 41 also includes a number of additional features, such as a three finger chord interpret feature, and turns on the note pattern and bass pattern circuits, depending on the status of some of the easy play tabs identified in the tab control block 54 (FIG. 1A). For example, if the microcomputer determines that the one finger chord feature is enabled and receives a single accompaniment keydown from the output FIFO 42, then it knows that it must generate three or four accompaniment notes automatically from that one keydown signal. This is done through a lookup table inside the microcomputer 41 both for the one finger and three finger chord interpret features. The three finger chord interpret feature is a system whereby the microcomputer identifies a plurality of notes being depressed as a particular chord, such as a C major, C minor, etc., and then sends the root note information to the appropriate circuit, such as the note pattern generator 55 via register control logic block 52.

Microcomputer 41 multiplexes the tabs and other control switches in block 54 via driver lines 56 and receiver lines 57 so that this information appears as a multiplexed data stream whereupon it is processed by microcomputer 41. Microcomputer 41 also has a group of three output lines 56*a* connected to solo voicing block 57*a* (FIG. 1C). The information carried by these lines is a binary code which turns field effect transistors on and off and enables various filters to select different voicing within block 57*a*. The information for this is derived from the tab block 54 over lines 57. Line 58 from microcomputer 41 carries the vibrato control signal and line 59 the delayed vibrato control signal. These are signals to analog circuitry in the organ which causes vibrato in the event that certain voice tabs are actuated, such as a solo violin, for example. When this occurs, microcomputer 41 is programmed to turn on that particular voice filter down in the solo voicing block 57*a* and also turns on delayed vibrato.

The various inputs and outputs for microcomputer 41 and additional details as to its programming and operation will be described at a later point.

Referring now particularly to FIG. 1B, the organ comprises four accompaniment units, which are in effect four capture tone generator/keyers 60, 61, 62 and 63, are assigned by microcomputer 41 through register control logic block 50 to play respective accompaniment tones. As mentioned earlier, microcomputer 41 communicates with register control logic block 50 over the eight bit bus 43 and transmits two eight bit words in succession to this block so that actually sixteen bits of information are input to block 50 on each key change that is being assigned. The data from register control logic block 50 is transmitted to accompaniment units 60, 61, 62 and 63 over four bit bus 64 from control logic block 50, and lines 65 determine which unit 60, 61, 62 or 63 and keyer therein is to accept the data. A two megahertz clock 66 is connected to each of the accompaniment units 60, 61, 62 and 63. Also connected to the accompaniment units is the chord snub control signal on line 67 from rhythm unit 68, and the musical rhythm accompaniment signal on line 69, which is a series of rhythmically occurring pulses used for keying the accompaniment tones in a rhythmic pattern.

Each of the accompaniment units 60, 61, 62 and 63 can be locked in phase relative to each other by phase locking circuits 70, 71, 72 and 73, respectively. Without phase locking, if two accompaniment units were selected to play the same tone but an octave apart or several octaves apart, it is possible that the tones could cancel portions of each other and not be additive thereby resulting in a tone which is musically unacceptable. By phase locking the tones in accordance with the present invention, the tones will all be additive so that there is no tone cancellation or any other unusual sound which would be musically unpleasing. Accompaniment keydown gate 74 is connected to the outputs of accompaniment units 60, 61, 62 and 63 and provides an output over line 75 through gate 76 to an audio killer 77 (FIG. 1C) so that the organ will not permit any audio sounds to be transmitted to the amplifier 78 and speaker 79 when there are no keys being played.

Accompaniment unit 60, 61, 62 and 63 are each capable of generating any accompaniment note which the organ is adapted to produce and, rather than keying tones produced by a central tone generator, they generate their own tones and key those tones in accordance with instructions received from microcomputer 41 through register control logic block 50.

Each of the accompaniment units 60, 61, 62 and 63 includes a top octave synthesizer running off the same master oscillator 66. The accompaniment units are controlled by a pitch and octave word from register control logic block 50.

Referring now also to FIG. 1A, the pitch data from accompaniment units 60, 61, 62 and 63 is connected to fill note logic block 80 over four groups of five bit lines 81, 82, 83 and 84, wherein the pitch information is transmitted as a four bit binary word, and a keydown signal appears on the fifth line. Also connected as an input to fill note logic block 80 over line 85 is the fill note on/off signal from block 86, which is controlled by signals from register control logic block 50. Fill note logic block 80 compares the binary word on lines 87 for the key currently being multiplexed with the pitch information from the accompaniment units 60, 61, 62 and 63, and produces on serial data line 88 a pulse when a match occurs. Since fill note logic block 80 is responsive only to pitch information, it will produce compare conditions for the next four corresponding notes in the scan following the highest note being played on the solo manual 32, and produces fill notes as serial data on line 88. This serial data is then summed with the serial data from multiplexer 33 and processed like any other serial data. Thus, the fill note system takes information from assignment-type tone generator/keyers controlled by a microcomputer and converts it to serial data for summing with the original multiplexed data stream for reprocessing by the microcomputer control system. As will be described at a later point, the fill note generation produces a window so that once the four fill notes have been played, no further keydown signals will be produced on line 88.

Turning now to the bass and rhythm block 89 (FIG. 1B) register control logic block 51 receives key change and steering data on bus 43 from microcomputer 41 and control signals from microcomputer 41 on lines 47. Register control logic block 51 receives information from microcomputer 41 and then selects within the bass and rhythm block 89 which registers are to have data written into them.

Contained within the bass and rhythm circuit 89 are the bass pattern block 90, which produces a rhythmic pattern of bass tones, and also produces straightforward pedal tones representative of the tones played on the pedalboard 30. The bass pattern is determined by the selected rhythm and the chord being played on the accompaniment manual 31 or the pedal played on pedalboard 30 and it includes an internal top octave synthesizer driven by the two megahertz pulse train on line 91. Bass/pedal pattern block 90 is controlled by pitch and octave data on lines 92 and is selected by control signals on register select line 93. It includes a read only memory which contains the data representative of the bass pattern to be played, and receives rhythm counts on bus **93*a* from rhythm unit 68. The output tones in the pattern are connected over line 95 to bass voicing block 96, which has an output 97 connected through summer 98 to audio killer 77 and amplifier 78**.

Rhythm unit 68 is driven by a rhythm clock signal on line 99 and is controlled by the data on lines 92 and 93 from register control logic block 51 in accordance with the programming of microcomputer 41. An output 100 carries the rhythm instrument trigger signal and is connected to the sine wave keyers 101, which internally produce the tones and the keying for the various drum voices, such as bass drum, conga, woodblock and the like on output lines 102. Sine wave keyers 101 are the subject of a copending patent application Ser. No. 275,984 filed June 22, 1981, and owned by the assignee of the present application.

Rhythm unit 68 also produces a rhythm repeat signal on lines 103 and a rhythm sync signal on lines 104. The output from rhythm unit 68 is carried by bus 105, which is a series of parallel lines carrying pulses for the various white noise rhythm voices. These lines are connected through rhythm voicing block 106, which receives a white noise signal from white noise generator 107, and produces on line 108 the various white noise-type instruments, such as cymbals. The rhythm voices are summed by summer 109 and connected over line 110 to summer 98 (FIG. 1C). The pedal keydown signal from bass/pedal pattern generator 90 is carried by line 111 through gate 76 to audio killer 77 (FIG. 1C).

Also connected to audio killer 77 through summer 98 over line 112 are the accompaniment tones from accompaniment voicing block 113 (FIG. 1B). Block 113 receives the tones from accompaniment units 60, 61, 62 and 63 and the voicing is selected by a binary word on lines 114 directly from microcomputer 41 (FIG. 1A).

Referring now to FIG. 1C, solo keyer block 115 comprises five assignment-type tone generator/keyer units 116, 117, 118, 119 and 120, which receive data from register control logic block 53 over four bit data bus 121 in three four bit nibbles, and register select signals over four bit bus 122. The tone data is received in pitch and octave format, which controls top octave synthesizers within each of the solo units 116–120 driven by a common high frequency clock to produce five solo tones on outputs 123, 124, 125, 126 and 127, respectively. These tones are in accordance with keys depressed on the solo manual 32 and are under the ultimate control of microcomputer 41 similarly to the manner in which the accompaniment units 60, 61, 62 and 63 (FIG. 1B) are controlled. Phase locking circuits 128, 129, 130, 131 and 132 serve to maintain each of the solo units 116–120 in phase so that cancellation does not occur for tones played within octave intervals of each other. Output lines 123, 124, 125, 126 and 127 are connected by line 133 to solo voicing block 57. Output lines 134 from solo units 116–120 carry pulses whenever a solo unit 116–120 is newly assigned or changed from one tone to another. These outputs are summed by OR gate 135 and connected to a solo oxxy block 136, which produces a pulse for a new keydown. Additional outputs from solo units 116–120 are summed by OR gate 137, which carries a signal connected through line 138 and OR gate 76 to audio killer 77. As described earlier, when no keys are depressed, audio killer turns off the audio circuit so that objectionable noise is avoided. Solo units 116–120 also receive inputs from line 103, which carries the rhythm repeat pulse from rhythm unit 68 (FIG. 1B).

Envelope mode select block 140 is controlled by data from buses 121 and 122 from register control logic block 53, and functions to select the sustain, whether long sustain, short sustain or percussion, depending on the voicing selected. This is under the control of the programming of microcomputer 41.

Solo keyer block 141 is controlled by microcomputer 41 through register control logic block 52. It comprises three additional solo tone generator/keyer units 142, 143 and 144 and envelope select 145 controlled by the data on four bit bus 146, which carries two four bit bytes in succession, and the control signals on bus 147. Solo units 142–144 include their own TOS circuits driven by a two megahertz clock 148, but are not phase locked as are solo units 116–120. Solo units 142–144 are intended to be captured when more than five notes are played on the solo manual. The outputs of solo units 142–144 are connected by line 149 to solo voicing block 57. OR gate 150 sums the solo keydown signal which is connected through OR gate 76 to audio killer 77, and OR gate 151 carries the signal for the oxxy block 152 similarly to block 136 discussed earlier.

Solo keyer block 141 comprises the note pattern generator block 55, which is controlled by the data written into it from buses 146 and 147. This data selects the note pattern to be played and also the root word, which is encoded from the accompaniment keys or chord played on the accompaniment manual 31. Again, microcomputer 41 is programmed to select the pattern and root tone.

The note pattern generator 55 is of the additive type wherein a binary word is added to the previously stored binary word to produce the note pattern. It is driven by the rhythm clock signal on line 153 and synchronized with the rhythm unit 68 by the rhythm sync signal on line 104.

Note pattern generator 55, like bass/pedal pattern generator 90, includes its own clock driven TOS system and produces on output line 154 a series of tones that are internally keyed and voiced by note pattern voicing circuit 155, the output 156 of which is connected through summer 98 and audio killer 77 to power amplifier 78 and speaker 79. Note pattern generator 55 and bass pattern generator 90 include decoding and tone generation circuitry similar to that in accompaniment units 60–63 and solo units 116–120 and 142–144, which will be described in detail hereinafter.

Solo keyer block 141 also includes a brass keyer circuit 157 which also includes its own TOS system and decoding system and produces on output line 158 tones having brass characteristics wherein both the amplitude and pulse width are modulated. Output 158 is connected through brass voicing block 159 to summer 98.

The microcomputer controlled electronic organ illustrated in FIGS. 1A, 1B and 1C is adapted to be implemented by large scale integration. The use of external capacitors has been virtually eliminated by using a switched capacitor technique, preferably of the double charge pump type disclosed in U.S. Pat. No. 4,367,670.

Figure 2:
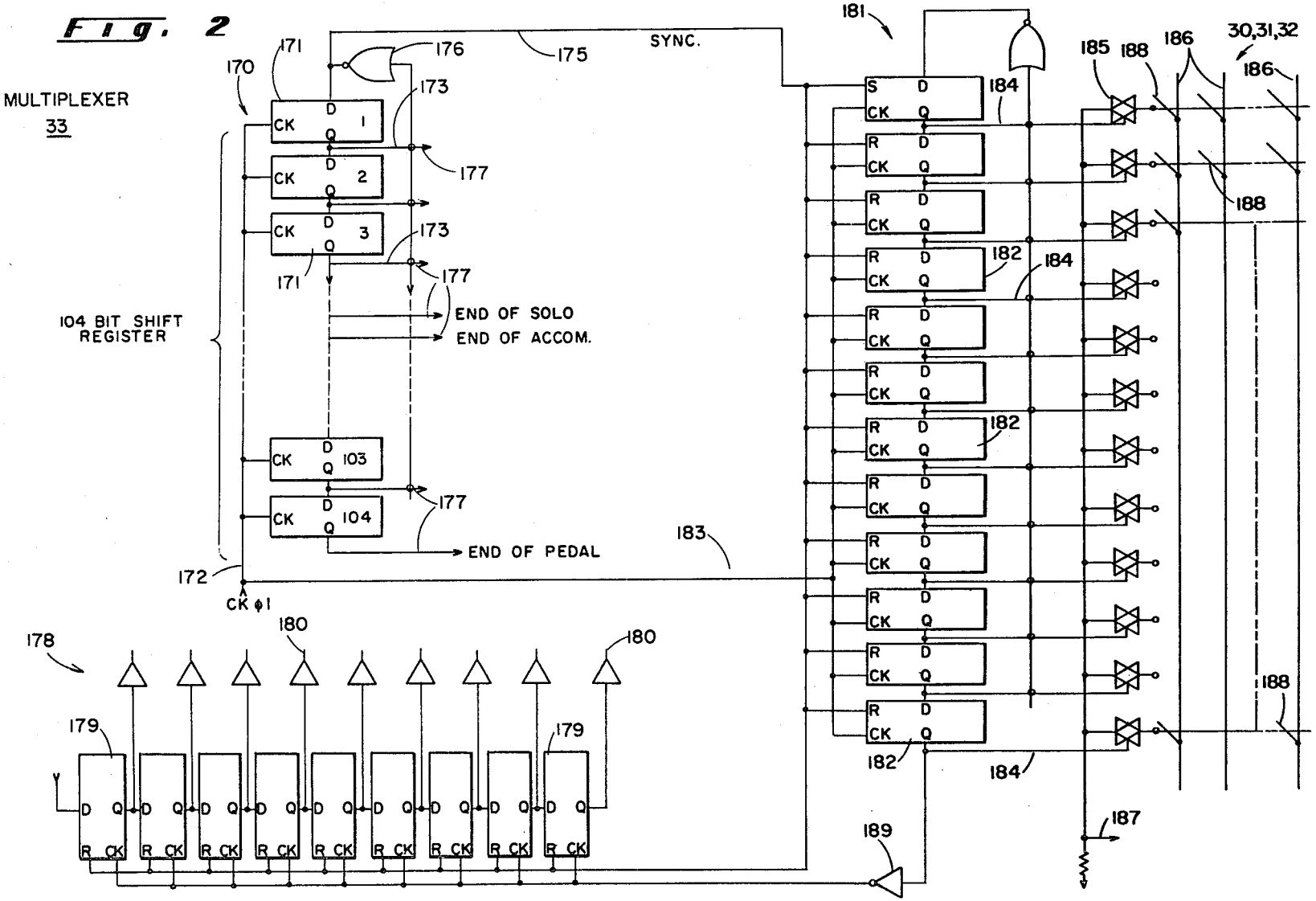
FIG. 2 is a circuit schematic of the multiplexer.

Referring now to FIG. 2, the details of multiplexer 33 are shown. Multiplexer 33 utilizes a nine driver by twelve receiver matrix technique comprising a one hundred and four bit shift register 170 including a plurality of stages 171 clocked by a phase one clock train on line 172. The output 175 of NOR gate 176 is used to preset/set shift registers 181 and 178 one cycle later for synchronization purposes. The Q output 173 of stages 171 are connected to address lines 177, and as indicated, an address line 177 is dedicated to a stage lying between the end of the scan of the solo manual and the beginning of the scan of the accompaniment manual, a further line 177 between the end of the scan of the accompaniment manual and the beginning of the scan of the pedal manual, and another line 177 at the end of the scan of the pedal manual.

Multiplexer 33 further comprises a nine bit shift register 178 comprising a plurality of stages 179 and Q outputs 180, which function as the drivers for the multiplexing of keyboards 30, 31 and 32. A twelve bit shift register 181 comprising stages 182 is clocked over line 183 by the same clock train that clocks shift register 170. The Q outputs 184 of shift register 181 are connected to the control terminals of bidirectional transmission gates 185 and function as the receivers for multiplexing of keyboards 30, 31 and 32.

Nine bit shift register 178 is clocked by the output of the last stage 182 of twelve bit shift register 181 and its outputs 180 are connected to the nine drive buses 186 connected to the keyswitches for manuals 30, 31 and 32 and to the inputs of transmission gates 185.

In operation, the first stage 179 of nine bit shift register 178 activates one of the driver buses 186 and the stages 182 of twelve bit shift register 181 are activated in succession by the clock train on line 183. This opens transmission gates 185 in succession so that a pulse will appear in a time slot on output line 187 for each of the closed key switches 188 connected in the usual manner to the activated bus 186. The Q output of the last stage 182 is connected through inverter 189 to the clocking inputs of shift register 178 so that the next stage thereof is activated, which then activates the next keyswitch bus 186. This results in a sequential scanning of the keyswitches 188 to produce on line 187 a multiplexed data stream having a time slot for each of the keyswitches 188 as well as time slots for the ends of the solo scan, the accompaniment scan and the pedal scan.

Figure 3:
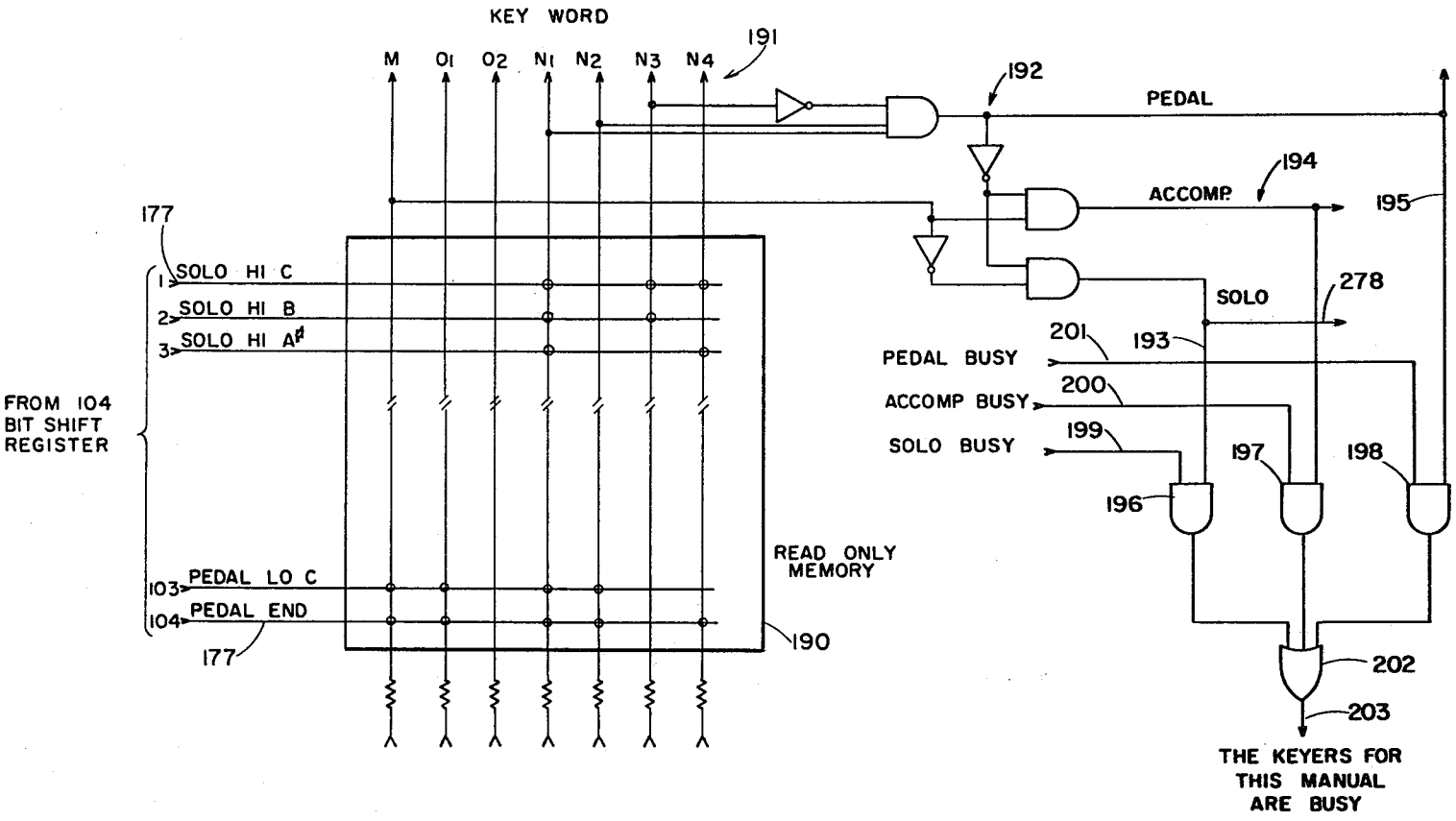
FIG. 3 is a circuit schematic of the key word read only memory and output gating.

Turning now to FIG. 3, output lines 177 from the one hundred and four bit shift register 170 are connected to the respective input lines of the key word read only memory 190. ROM 190 is programmed to produce on its seven output lines 191 denoted M 01, 02, N1, N2, N3 and N4. Thus, a unique seven bit binary word is produced for each keyswitch 188 as well as the end of solo, end of accompaniment and end of pedal time slots.

The most significant bit M of the key word on lines 191 is logic 0 during the scan of the solo manual and logic 1 during the scan of the accompaniment manual, but if the N1, N2 and N3 bits are binary 110, then the word always denotes a pedal. The 01 and 02 bits encode the octave of the particular manual which the word pertains to, and the N1–N4 bits contain the pitch information, all in binary notation. By this scheme, the forty-four solo notes, the forty-four accompaniment notes and the thirteen pedal notes as well as the end of manual scan signals are represented by the one hundred and four key words corresponding to the one hundred and four locations within read only memory 190. As mentioned earlier, the sequence of addressing is from high to low beginning with the highest key in the solo manual 32 and ending with the lowest pedal on the pedalboard. For purposes of the block diagram of FIG. 1A, ROM 190 is contained within the new keydown and release detect block 40.

Also shown in FIG. 3 is a decoding circuit 192 having outputs from the M, N1, N2 and N3 lines for the key word, which activates line 193 when the solo manual 32 is being scanned, line 194 when the accompaniment manual 31 is being scanned, and line 195 when the pedal manual is being scanned. Lines 193, 194, and 195 are connected to the inputs of AND gates 196, 197 and 198, respectively, the other inputs of which are connected to lines 199, 200 and 201, respectively. Lines 199, 200 and 201 carry signals denoting that all keyers for the solo, accompaniment and pedal manuals, respectively, are busy, and the outputs of AND gates 196, 197 and 198 are collected by OR gate 202 having as its output line 203, which carries a binary level at the time of the scan of the respective manuals 30, 31 and 32 indicating whether the keyers (FIGS. 1B and 1C) for that manual are busy.

The following is a table of the read only memory key words for the scan of manuals 30, 31 and 32:

| | | M | 01 | 02 | N1 | N2 | N3 | N4 |
|---|---|---|---|---|---|---|---|---|
| Solo Hi | C | 0 | 0 | 0 | 1 | 0 | 1 | 1 |
| | B | 0 | 0 | 0 | 1 | 0 | 1 | 0 |
| | A# | 0 | 0 | 0 | 1 | 0 | 0 | 1 |
| | A | 0 | 0 | 0 | 1 | 0 | 0 | 0 |
| | G# | 0 | 0 | 0 | 0 | 1 | 1 | 1 |
| | G | 0 | 0 | 0 | 0 | 1 | 1 | 0 |
| | F# | 0 | 0 | 0 | 0 | 1 | 0 | 1 |
| | F | 0 | 0 | 0 | 0 | 1 | 0 | 0 |
| | E | 0 | 0 | 0 | 0 | 0 | 1 | 1 |
| | D# | 0 | 0 | 0 | 0 | 0 | 1 | 0 |
| | D | 0 | 0 | 0 | 0 | 0 | 0 | 1 |
| | C# | 0 | 0 | 0 | 0 | 0 | 0 | 0 |
| | C | 0 | 0 | 1 | 1 | 0 | 1 | 1 |
| | B | 0 | 0 | 1 | 1 | 0 | 1 | 0 |
| | A# | 0 | 0 | 1 | 1 | 0 | 0 | 1 |
| | A | 0 | 0 | 1 | 1 | 0 | 0 | 0 |
| | G# | 0 | 0 | 1 | 0 | 1 | 1 | 1 |
| | G | 0 | 0 | 1 | 0 | 1 | 1 | 0 |
| | F# | 0 | 0 | 1 | 0 | 1 | 0 | 1 |
| | F | 0 | 0 | 1 | 0 | 1 | 0 | 0 |
| | E | 0 | 0 | 1 | 0 | 0 | 1 | 1 |
| | D# | 0 | 0 | 1 | 0 | 0 | 1 | 0 |
| | D | 0 | 0 | 1 | 0 | 0 | 0 | 1 |
| | C# | 0 | 0 | 1 | 0 | 0 | 0 | 0 |
| | C | 0 | 1 | 0 | 1 | 0 | 1 | 1 |
| | B | 0 | 1 | 0 | 1 | 0 | 1 | 0 |
| | A# | 0 | 1 | 0 | 1 | 0 | 0 | 1 |
| | A | 0 | 1 | 0 | 1 | 0 | 0 | 0 |
| | G# | 0 | 1 | 0 | 0 | 1 | 1 | 1 |
| | G | 0 | 1 | 0 | 0 | 1 | 1 | 0 |
| | F# | 0 | 1 | 0 | 0 | 1 | 0 | 1 |
| | F | 0 | 1 | 0 | 0 | 1 | 0 | 0 |
| | E | 0 | 1 | 0 | 0 | 0 | 1 | 1 |
| | D# | 0 | 1 | 0 | 0 | 0 | 1 | 0 |
| | D | 0 | 1 | 0 | 0 | 0 | 0 | 1 |
| | C# | 0 | 1 | 0 | 0 | 0 | 0 | 0 |
| Solo Lo | C | 0 | 1 | 1 | 1 | 0 | 1 | 1 |
| | B | 0 | 1 | 1 | 1 | 0 | 1 | 0 |
| | A# | 0 | 1 | 1 | 1 | 0 | 0 | 1 |
| | A | 0 | 1 | 1 | 1 | 0 | 0 | 0 |
| | G# | 0 | 1 | 1 | 0 | 1 | 1 | 1 |
| | G | 0 | 1 | 1 | 0 | 1 | 1 | 0 |
| | F# | 0 | 1 | 1 | 0 | 1 | 0 | 1 |
| | F | 0 | 1 | 1 | 0 | 1 | 0 | 0 |
| Solo End | | 0 | 1 | 1 | 1 | 1 | 1 | 1 |
| Acc. Hi | C | 1 | 0 | 0 | 1 | 0 | 1 | 1 |
| | B | 1 | 0 | 0 | 1 | 0 | 1 | 0 |
| | A# | 1 | 0 | 0 | 1 | 0 | 0 | 1 |
| | A | 1 | 0 | 0 | 1 | 0 | 0 | 0 |
| | G# | 1 | 0 | 0 | 0 | 1 | 1 | 1 |
| | G | 1 | 0 | 0 | 0 | 1 | 1 | 0 |
| | F# | 1 | 0 | 0 | 0 | 1 | 0 | 1 |
| | F | 1 | 0 | 0 | 0 | 1 | 0 | 0 |
| | E | 1 | 0 | 0 | 0 | 0 | 1 | 1 |
| | D# | 1 | 0 | 0 | 0 | 0 | 1 | 0 |
| | D | 1 | 0 | 0 | 0 | 0 | 0 | 1 |
| | C# | 1 | 0 | 0 | 0 | 0 | 0 | 0 |
| | C | 1 | 0 | 1 | 1 | 0 | 1 | 1 |
| | B | 1 | 0 | 1 | 1 | 0 | 1 | 0 |
| | A# | 1 | 0 | 1 | 1 | 0 | 0 | 1 |
| | A | 1 | 0 | 1 | 1 | 0 | 0 | 0 |
| | G# | 1 | 0 | 1 | 0 | 1 | 1 | 1 |
| | G | 1 | 0 | 1 | 0 | 1 | 1 | 0 |
| | F# | 1 | 0 | 1 | 0 | 1 | 0 | 1 |
| | F | 1 | 0 | 1 | 0 | 1 | 0 | 0 |
| | E | 1 | 0 | 1 | 0 | 0 | 1 | 1 |
| | D# | 1 | 0 | 1 | 0 | 0 | 1 | 0 |
| | D | 1 | 0 | 1 | 0 | 0 | 0 | 1 |
| | C# | 1 | 0 | 1 | 0 | 0 | 0 | 0 |
| | C | 1 | 1 | 0 | 1 | 0 | 1 | 1 |
| | B | 1 | 1 | 0 | 1 | 0 | 1 | 0 |
| | A# | 1 | 1 | 0 | 1 | 0 | 0 | 1 |
| | A | 1 | 1 | 0 | 1 | 0 | 0 | 0 |
| | G# | 1 | 1 | 0 | 0 | 1 | 1 | 1 |
| | G | 1 | 1 | 0 | 0 | 1 | 1 | 0 |
| | F# | 1 | 1 | 0 | 0 | 1 | 0 | 1 |
| | F | 1 | 1 | 0 | 0 | 1 | 0 | 0 |
| | E | 1 | 1 | 0 | 0 | 0 | 1 | 1 |
| | D# | 1 | 1 | 0 | 0 | 0 | 1 | 0 |
| | D | 1 | 1 | 0 | 0 | 0 | 0 | 1 |
| | C# | 1 | 1 | 0 | 0 | 0 | 0 | 0 |
| Acc. Lo | C | 1 | 1 | 1 | 1 | 0 | 1 | 1 |
| | B | 1 | 1 | 1 | 1 | 0 | 1 | 0 |
| | A# | 1 | 1 | 1 | 1 | 0 | 0 | 1 |
| | A | 1 | 1 | 1 | 1 | 0 | 0 | 0 |
| | G# | 1 | 1 | 1 | 0 | 1 | 1 | 1 |
| | G | 1 | 1 | 1 | 0 | 1 | 1 | 0 |
| | F# | 1 | 1 | 1 | 0 | 1 | 0 | 1 |
| | F | 1 | 1 | 1 | 0 | 1 | 0 | 0 |
| Acc. End | | 1 | 1 | 1 | 1 | 1 | 1 | 1 |
| Pedal Hi | C | 0 | 0 | 0 | 1 | 1 | 0 | 0 |
| | B | 0 | 0 | 0 | 1 | 1 | 0 | 1 |
| | A# | 0 | 0 | 1 | 1 | 1 | 0 | 0 |
| | A | 0 | 0 | 1 | 1 | 1 | 0 | 1 |
| | G# | 0 | 1 | 0 | 1 | 1 | 0 | 0 |
| | G | 0 | 1 | 0 | 1 | 1 | 0 | 1 |
| | F# | 0 | 1 | 1 | 1 | 1 | 0 | 0 |
| | F | 0 | 1 | 1 | 1 | 1 | 0 | 1 |

-continued

| | M | 01 | 02 | N1 | N2 | N3 | N4 |
|---|---|---|---|---|---|---|---|
| E | 1 | 0 | 0 | 1 | 1 | 0 | 0 |
| D# | 1 | 0 | 0 | 1 | 1 | 0 | 1 |
| D | 1 | 0 | 1 | 1 | 1 | 0 | 0 |
| C# | 1 | 0 | 1 | 1 | 1 | 0 | 1 |
| Lo C | 1 | 1 | 0 | 1 | 1 | 0 | 0 |
| Pedal End | 1 | 1 | 0 | 1 | 1 | 0 | 1 |

Multiplexer 33 operates continuously and the seven bit key words produced thereby are being produced in rapid succession without regard to the state of microcomputer 41 or its ability to accept a new key word. A change in the states of the keys on manuals 30, 31 and 32 is determined by the new keydown and release detect block 40 and it, together with FIFOs 42 and 45, store this key change information until microcomputer 41 is able to accept it. Thus, the system monitors the rapidly reoccurring serial data stream to determine a change in keydown data and when such a change is detected, this information is stored without interrupting the multiplexing of manuals 30, 31 and 32. This is advantageous in that the serial data information from manuals 30, 31 and 32 can be utilized for the fill note generation discussed earlier and for other organ peripherals which respond to serial data. If the serial data were interrupted each time new key information is transmitted to the microcomputer 41, then such interfacing would be very difficult to implement.

Figure 4:
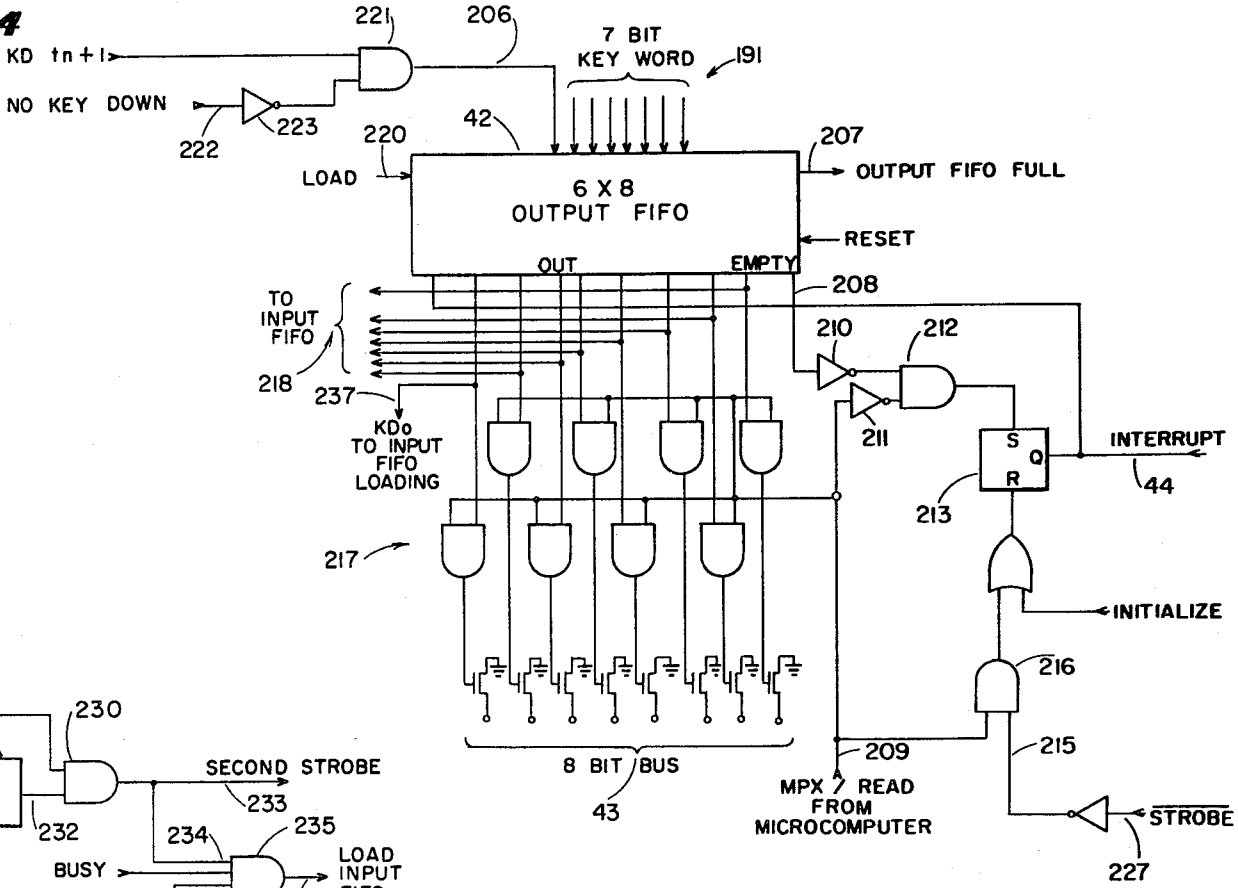
FIG. 4 is a schematic of the output FIFO circuit.

With reference now to FIG. 4, the loading of the output FIFO 42 will be described. Output FIFO 42 is a storage buffer for the key words to be transmitted from the interface between multiplexer 33 and the microcomputer 41, such interface being the serial debouncer 39 and the new keydown/release detector and ROM 40. Buffer 42 permits demultiplexing and debouncing to continue at the scan rate without having to stop when transmission is made to the microcomputer 41. Furthermore, the microcomputer 41 receives data whenever it is ready without having to wait for the multiplexer 33 and ROM 190 to increment to the keyswitch location that is required to be transmitted.

FIFO 42 is six by eight bits in size with seven of the eight bits coming from the outputs 191 out of ROM 190 (FIG. 3) and the last bit on input 206 indicating whether it is keydown or key release data. This last bit is necessary since only changes in the debounced keyboard information are transmitted to microcomputer 41. The six bytes were selected because of the execution time of a 3870 microcomputer program with respect to the speed of multiplexer 33. The FIFO memory is a static RAM which is addressed by two different pointers, the read pointer for reading the data from the FIFO 42 by the microcomputer 41, and the write pointer for writing data into FIFO 42 from new keydown block 40. By comparing the relative positions of these two pointers, buffer 42 develops an output FIFO full signal on line 207 and an output FIFO empty signal on line 208.

Line 209, which is an output from microcomputer 41 on the group of lines denoted 46 in FIG. 1A, is the inverted multiplex/read signal. When both lines 208 and 209 are low, these signals are inverted by inverters 210 and 211 to thereby produce a logic 1 on the output of AND gate 212, which sets flip-flop 213. This produces an interrupt signal on line 44 to notify microcomputer 41 that there is data in buffer 42 that needs to be read at that particular time. Flip-flop 213 is reset when microcomputer 41 acknowledges the interrupt and places a logic 1 on line 209. This, together with the strobe signal on line 215 produces a logic 1 at the output of AND gate 216 and resets flip-flop 213.

As indicated earlier, the eight bit data bus 43 is bidirectional and microcomputer 41 determines whether it is used to receive data from output FIFO 42 or used to transmit data to various other blocks in the system. AND gates 217 are enabled by the multiplex/read signal from microcomputer 41 to enable the data within buffer 42 to be placed on bus 43. Lines 218 from the output of output FIFO 42 are connected to the inputs of input FIFO 219, which is shown in FIG. 5.

Output FIFO 42 is loaded by a signal on line 220, the origin of which will be described in detail at a later point. The eight bit word which is loaded into FIFO 42 is identified as either a keydown or a key release signal from the output of AND gate 221. One input thereto is a signal on line 222 inverted by inverter 223, which disables gate 221 whenever no keys are depressed on a manual, thereby placing a logic 0 on line 206 denoting that this particular manual is not actuated. The other input to AND gate 221 is the KDtn+1, which is the serial data bit presently being output by debouncer 39 concurrently with the scanning of that keyswitch by multiplexer 33. Accordingly, if KDtn+1 is a logic 1 denoting that that key is depressed, then a logic 1 will appear on the output of AND gate 221. Conversely, if the key is released, then KDtn+1 will be a logic 0 thereby placing a logic 0 on line 206 to the input of output FIFO 42.

Figure 5:
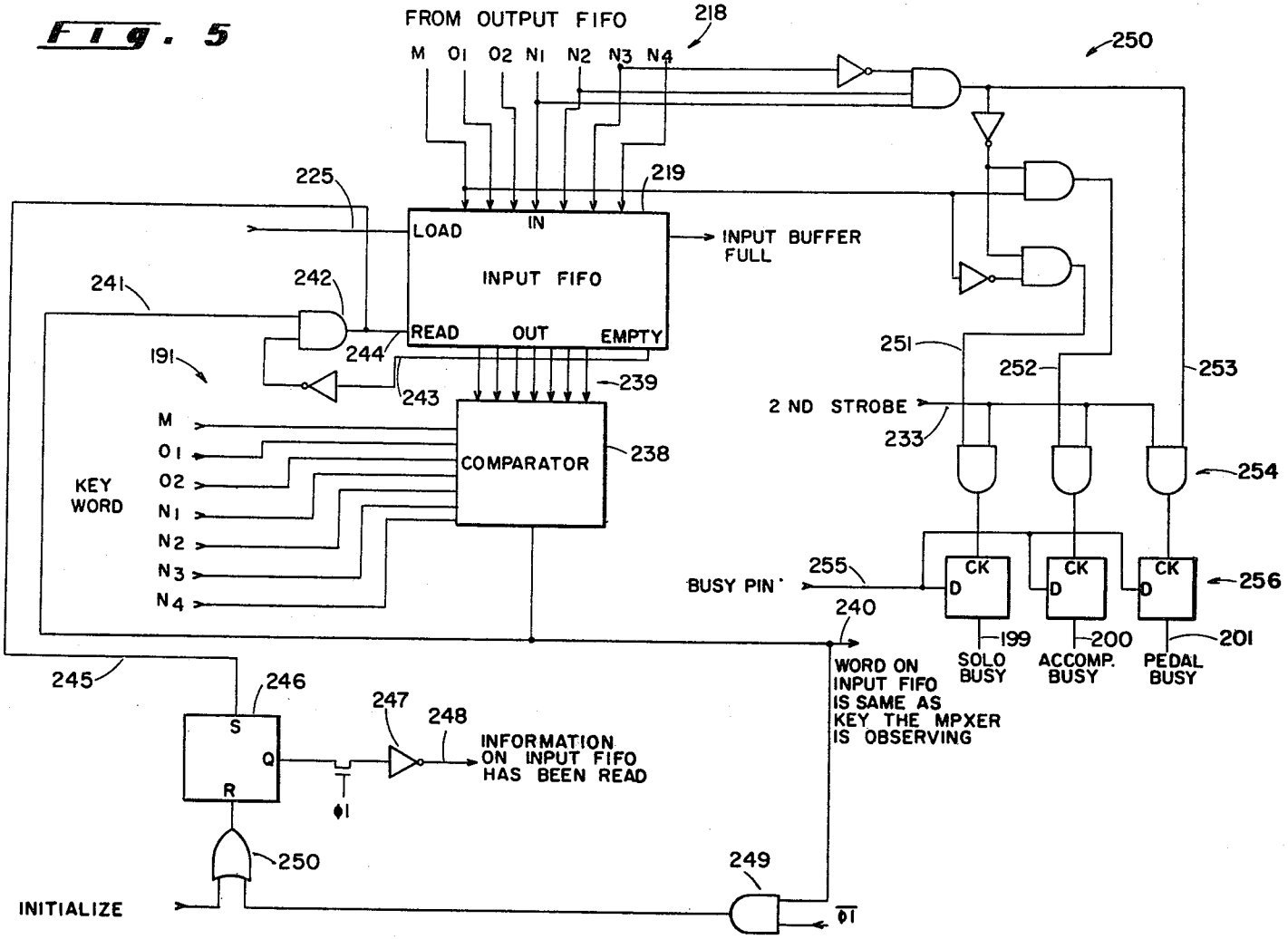
FIG. 5 is a schematic of the input FIFO circuit.

FIG. 5 illustrates input FIFO 219, which is a storage device in which the keydown information which has not been assigned to keyers is temporarily stored. In it can be stored six seven bit words and in many aspects it is similar to the eight bit wide output buffer 42 shown in FIG. 4, except that it requires only seven bits of information because only keydown information is stored in it. Since key release information results in the freeing up of more keyers, this information will always be transmitted to microcomputer 41 so that the appropriate keyers can be deassigned.

Figure 6:
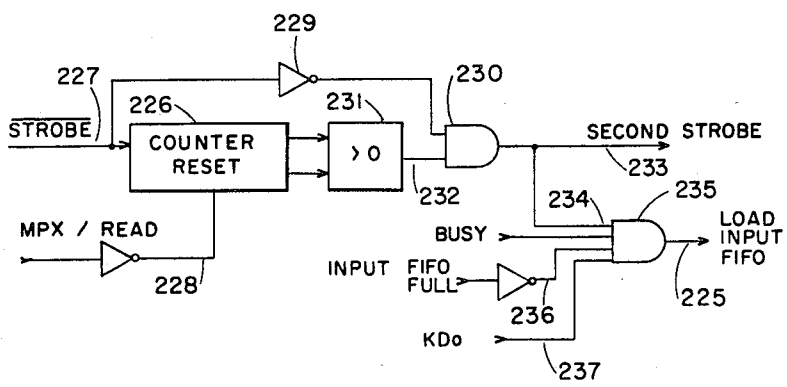
FIG. 6 is a schematic of the strobe and load circuit for the input FIFO.

Input FIFO 219 receives the seven bit key word over lines 218 from output FIFO 42, which is the data that is being sent by output FIFO 42 to microcomputer 41. The load signal for input FIFO 219 on line 225 is generated by the circuitry shown in FIG. 6. The input to counter 226 is the inverted strobe signal from microcomputer 41 on line 227 and the multiplex/read signal from microcomputer 41 on line 228. The signal on line 227 is inverted by inverter 229 and connected to one input of AND gate 230. The outputs of counter 226 are connected to a comparator 231, which produces a logic 1 signal on the input 232 of AND gate 230 when the count is greater than 0. What occurs is that the first strobe pulse is not permitted to pass but the second strobe pulse enables AND gate 230 to produce a logic 1 on line 233 and one of the inputs 234 of AND gate 235. Another input to AND gate 235 is a busy signal from the microcomputer 41, a third signal is the inverted input FIFO full signal on line 236 that produces a logic 1 whenever the input FIFO is not full, and the last input on line 237 is the signal indicating whether the key information is a key depressed or key released state, and if it is a key depressed state, then a logic 1 will appear on this line. AND gate 235 functions to produce a logic 1 on its output 225 on the second strobe pulse when microcomputer 41 is receiving data from output FIFO 42, when the keyers for that particular key are busy, when the input FIFO is not yet full, and when the key information is a key depressed condition. Thus, input FIFO 219 will be loaded with the data transmitted to microcomputer 41 just after microcomputer 41 determines that the data will not be accepted due to all the keyers for that key being previously captured, and it is therefore necessary to temporarily store this information so that it can again be presented to microcomputer in the future in the event that one of the keyers in question is released.

Comparator 238 compares the output 239 from input FIFO 219 with the key word on lines 191 from ROM 190 (FIG. 3), and when a compare condition is present thereby indicating that the word on the input FIFO 219 is the same as the key that multiplexer 33 is observing, a logic 1 is placed on lines 240 and 241. The signal on line 241 is gated through AND gate 242 with the inverted input FIFO empty signal on line 243, and this places a read signal on input 244 thereby indicating that the input FIFO has been read and can be incremented to read the next word. When input FIFO 219 is incremented, the signal on line 245 is latched by flip-flop 246, and the Q output thereof is inverted by inverter 247. Output 248 is low whenever the input FIFO has not been read, and when the logic 1 appears on line 240, AND gate 249 passes this signal during phase one to reset flip-flop 246 through OR gate 250, thereby placing a logic 1 on output 248 indicating that the input FIFO has now been read.

Still referring to FIG. 5, decoding circuitry 250 decodes the M, N1, N2 and N3 inputs to input FIFO 219, which are the outputs from output FIFO 42, and activates lines 251, 252 and 253 during the time that the key word being transmitted from the output FIFO 42 to microcomputer 41 and to input FIFO 219 originates from the solo, accompaniment and pedal manuals, respectively. AND gates 254 are enabled during the second strobe pulse, which is after the microcomputer 41 has accepted or rejected the data, to thereby latch the busy information on busy pin 255 from microcomputer 41 in latches 256. The outputs 199, 200 and 201 from latches 256 are connected to AND gates 196, 197 and 198 in FIG. 3.

Figure 7:
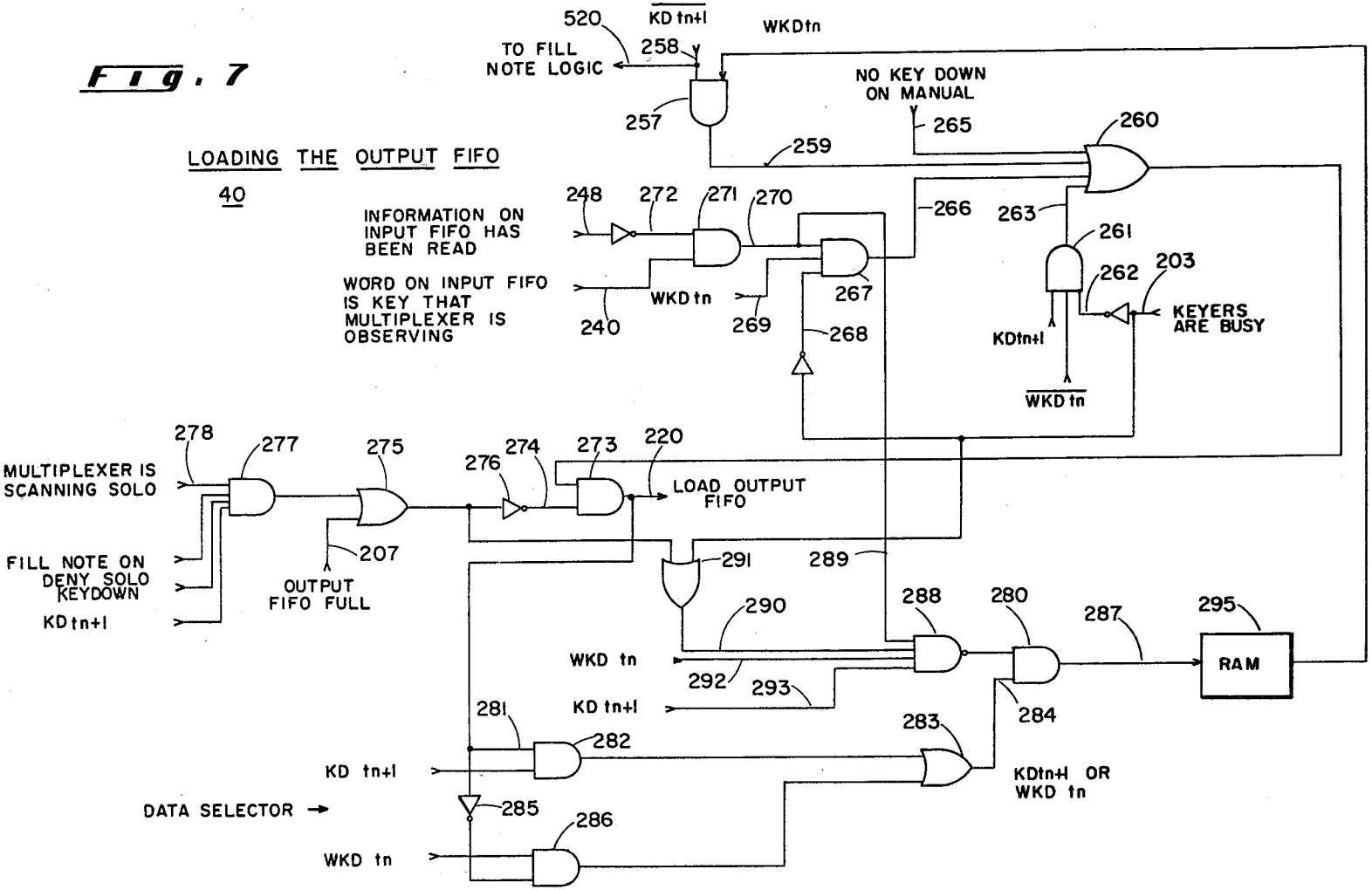
FIG. 7 is a schematic of the output FIFO loading circuit.

FIG. 7 illustrates the circuitry for loading output FIFO 42. At the inputs of AND gate 257 are the inverted KDtn+1 signals and the WKDtn. As mentioned earlier, the KDtn+1 signal on input 258 is the logic level for that time frame which the debouncer 39 is outputting concurrently with the scanning of that keyswitch. If the keyswitch is depressed, then KDtn+1 will be a logic 1, and its inversion on input 258 will be at logic 0. WKDtn, on the other hand, is the logic level which was last sent to microcomputer 41 for that particular time frame. This information is produced by the circuitry of FIG. 7 and is stored in the random access memory 295 in serial debouncer 39. Thus, for each time slot, the inputs to AND gate 257 are the debounced logic level presently produced by the debouncer 39 and the logic level stored in the debouncer last sent to microcomputer 41 for that key. Since the input on line 258 is the inverted key information, AND gate 257 will produce a logic 1 on line 259 only when the key for that time slot was previously depressed and its information was translated to microcomputer 41, but the key is now released. This signal is transmitted to one of the inputs of OR gate 260.

AND gate 261 has as one of its inputs the KDtn+1 (noninverted) signal, and as another input the inverted WKDtn, which is exactly the opposite state as on the inputs of AND gate 257. A third input 262 is the inverted signal from line 203, which will be at a logic 1 when a keyer for that manual being scanned is available. The output 263 of AND gate 261 is connected to another input of OR gate 260. A fourth input 265 is at a logic 1 when no key on the manual is depressed, thereby forcing the system to enter a key released state into microcomputer 41.

The output 266 of AND gate 267 is also connected to OR gate 260, and this AND gate 267 has three inputs, one of which is the inverted keyer busy signal on line 268. Another input is the WKDtn signal on line 269, which is at a logic 1 when the information previously sent to microcomputer 41 for that keyswitch is a key depressed condition. The last input is the output 270 of AND gate 271 which has as its inputs the inverted signal from line 248, which was generated in FIG. 5 and indicates that the information on the input FIFO 219 has been read. Thus, if the information on the input FIFO has not been read, then a logic 1 will be present on the input 272 of AND gate 271. The other input is line 240 from FIG. 5 which is an indication that the word on the input FIFO 219 is the same as the key which multiplexer 33 is presently scanning. If all of the conditions for AND gate 267 are met, that is, the information on the input FIFO 219 has not been read, the word on the input FIFO is the key that is presently being multiplexed, the previous information sent to microcomputer 41 for that key was a key depressed condition, and the keyers for that manual are not busy, then AND gate 267 will place a logic 1 on the appropriate input of OR gate 260.

When any of the inputs of OR gate 260 are at logic 1, AND gate 273 will be enabled to load output FIFO 42 if its other input 274 is also at logic 1. If the output FIFO 42 is full as indicated by a logic 1 on line 207, then OR gate 275 and inverter 276 will operate to disable AND gate 273 and output FIFO 42 will not be loaded. Furthermore, even though the output FIFO may be less than full, if all of the inputs of AND gate 277 are at logic 1, then AND gate 273 will be disabled. This occurs if multiplexer 33 is scanning the solo manual as indicated by a logic 1 on line 278 (FIG. 3), the fill note generation feature is activated, and the present key being scanned is a key depressed condition, and then AND gate 273 will be disabled and the output FIFO 42 will not be loaded. This is to avoid playing undesired notes when the fill note generation system is implemented, which is a feature whereby notes played on the accompaniment manual 31 are automatically filled in in the highest played octave on solo manual 32.

The net result of the circuitry discussed above is that output FIFO 42 will be loaded when the condition of the key presently being scanned changes, that is, when it was previously depressed and is now released, or was previously released and is now depressed. As was indicated earlier, output FIFO 42 retains the eight bit data word and outputs it to microcomputer 41 when microcomputer 41 is in a position to accept it. If it is not accepted by microcomputer 41, as it would not be if all of the keyers for that manual are captured, then it would be loaded into input FIFO 219, incremented and read out in synchronism with the multiplexing of that keyswitch at a later time and then again loaded into output FIFO 42 so that a further attempt can be made to load it into microcomputer 41. For example, if all of the keyers for the accompaniment manual are busy and an additional key in the accompaniment manual is depressed, this key will not result in the production of a tone until one of the keyers is released. Once this is done, then AND gate 261 (FIG. 7) will be enabled and AND gate 273 will produce the load signal on line 220 thereby causing the data word to be loaded into output FIFO 42. When the data word is accepted by microcomputer 41, it will capture the appropriate available keyer 60, 61, 62 or 63.

When the data word appears on the input FIFO 219, this signifies that microcomputer 41 has realized that there is no place for it in the capture keyers assigned to that manual. If conditions are correct, this data will be sent again, and the conditions are correct if the inputs of AND gate 267 are all at logic 1. This will be the case if that particular word being scanned is in the input FIFO a key depressed instruction was previously sent or attempted to be sent to microcomputer 41 and there is room in the capture keyer system for that key. If this isn't the case, however, such as if the word appears on input FIFO 219 and it can't be sent to microcomputer 41, it is necessary to produce a logic 0 on the output of AND gate 280 (WKDtn+1), and store this in the random access memory 295 of serial debouncer 39 thereby indicating that the data for this key was not sent to microcomputer 41 and that microcomputer 41 perceives this key as being released. Therefore, a further attempt will be made to transmit the data for this key to microcomputer 41.

The inputs to AND gate 280 determine what logic level should be stored representing the data last sent to microcomputer 41 for that particular keyswitch.

In order to store the appropriate WKDtn logic level in the RAM 295 in debouncer 39, it is necessary to determine whether output buffer 42 has been loaded or not. If output buffer 42 has been loaded as indicated by a logic 1 on line 220, this places a logic 1 on the input 281 of AND gate 282 thereby enabling this gate and permitting the KDtn+1 signal, which is the logic level for the keyswitch presently being scanned, to pass through OR gate 283 to the input 284 of AND gate 280. If, on the other hand, the output FIFO 42 was not loaded for any one of the reasons discussed earlier, then AND gate 282 would be disabled and inverter 285 would cause the enabling of AND gate 286, which has as its other input the WKDtn signal. As will be recalled, this signal is the last state for this time slot which was sent to microcomputer 41. In other words, the output 287 of AND gate 280, which is the WKDtn+1 signal to be stored and which will later be connected to AND gates 257 and 261 as the WKDtn signal, it is either the new key depressed or key released information or, if the output buffer 42 was not loaded, the previous key depressed or key released information sent to microcomputer 41.

AND gate 280 will be enabled if the output of NAND gate 288 is at a logic 1. This will occur if any one of its inputs is at logic 0. One input 289 is the output of AND gate 271, which will be a logic 1 when the information on the input FIFO 219 has not been read and when that information is the key that the multiplexer is presently observing. Input 290 from OR gate 291 is either a signal that all of the keyers are busy for that particular key or that the output FIFO 42 is full. Input 292 is the WKDtn signal and input 293 is the KDtn+1 signal, which are at logic 1 if both the key is presently depressed and the last information sent to microcomputer 41 was that the key was depressed. If all these conditions are met, then the output of NAND gate 288 will be at logic 0 thereby automatically forcing the WKDtn+1 signal stored in the random access memory to be at logic 0. This indicates that the previous information sent for this key is a key released condition. If any one of the conditions are not met, then AND gate 280 will be enabled and either the present or previously stored information will be transmitted to the debouncer RAM 295.

To summarize the operation of the system thus far, multiplexer 33 continuously scans manuals 30, 31 and 32, this serial data is debounced and enters the new keydown and release detect and read only memory block 40, which determines whether a different condition exists for that key than was previously sent to microcomputer 41. If the condition has not changed, then the previously entered information is stored in RAM 295 and nothing is loaded input output buffer 42. If, however, the key was previously depressed and now released or vice versa, the circuitry of FIG. 5 will produce a control signal on line 220 thereby causing the output FIFO 42 to be loaded with the key word, and this word is then transmitted to microcomputer 41, which either accepts it if keyers are available, or rejects it if all of the keyers for that manual are presently captured. If the key word is rejected, it is loaded into input FIFO 219 and the data is recirculated so that it can again be loaded input output FIFO 42 when a keyer is released.

Once a keyer is released, then microcomputer 41 will accept the data and transmit it to the appropriate register control logic block 50, 51, 52 or 53 (FIGS. 1B and 1C) which steers it to the appropriate keyer unit to produce the requisite tone.

The operation and programming of microcomputer 41 will now be described by means of a description of its pin connections, a summary of its program, and the program itself in machine language.

Manufacturer's pins 1 and 2 of the 3870 microcomputer chip are adapted to be connected to an external oscillator, if such would be desired. Pins 3, 4 and 5 are the binary control lines for the solo voicing block 57 (FIG. 1C), and are connected to lines 56. As indicated earlier, they carry a three bit binary code to select the appropriate filtering for voicing of the solo notes. Pin 6 is the vibrato on/off control line, and is connected to line 58 in FIG. 1A. Pin 7 is the inverted strobe signal connected to line 227 and through an inverter to line 215 in FIG. 4.

Pins 8 through 15 form the eight bit bidirectional data bus 43, which carries data between microcomputer 41 and the register control logic blocks 50, 51, 52 and 53 and the output FIFO 42. Strobe pin 7 pulses a logic 0 each time microcomputer 41 is placing data on the eight bit bus formed by pins 8 through 15. Pin 16 is the MPX/$\overline{\text{READ}}$ which is logic 1 when the microcomputer 41 is receiving data from output FIFO 42, and logic 0 when it is communicating with the register control logic blocks 50, 51, 52 and 53.

Pin 17 is the BUSY/BYTE COUNT pin, which has two functions. When the MPX/$\overline{\text{READ}}$ line is high if output FIFO 42 is communicating with microcomputer 41, then pin 17 functions as a busy line, and would be set high if all the keyers for that particular manual are already captured. When pin 16 is low and microcomputer 41 is communicating with the register control logic blocks 50–53, then pin 17 functions as a byte counter for the eight bit bus 43. As mentioned earlier, the data to the register control logic blocks 50–53 are each sixteen bits wide, but since bus 43 is only eight bits wide, the bits must be sent out in two eight bit bytes. Pin 17 controls the release of the two eight bit bytes by microcomputer 41 when it is communicating with the register control logic blocks 50–53.

Pin 18 carries the chip initialize signal for the entire system, pin 19 is the delay vibrato signal connected to line 59 (FIG. 1A), pin 20 is the system ground, and pin 21 is a test pin. As indicated earlier, the tabs in block 54 are multiplexed by microcomputer 41, and pins 22, 23, 24, 25, 34 and 35 are connected to the driver lines 56, whereas pins 26, 27, 28, 29, 30, 31, 32 and 33 are the receiver pins connected to receiver lines 57. Pins 36 and 37 carry the two bit binary control signal for the accompaniment voicing block 113 and are connected to lines 115. Pin 38 is the external interrupt pin connected to interrupt line 44 (FIGS. 1A and 4), pin 39 is a manufacturer supplied reset pin that reinitializes microcomputer 41 to start at address zero, and pin 40 is connected to VCC voltage.

The following is a summary of the sequence of operation of microcomputer 41.

I. Mainline
- A. Initialize
  - 1. Output chip reset pulse
  - 2. Clear internal memory
  - 3. Initialize the queue's
- B. Multiplex tabs
  - 1. Multiplex rhythm tabs
    - (a) Prioritizes
    - (b) Automatically selects solo voices, special effects, accompaniment voices, note pattern and bass patterns.
  - 2. Multiplex Special Effects tabs
    - (a) Prioritizes
    - (b) Automatically selects solo voices and special effects
  - 3. Multiplex Tibia tabs
  - 4. Multiplex Generals
    - (a) Delay vibrato
    - (b) Vibrato
    - (c) Long sustain
    - (d) Short sustain
    - (e) Pedal sustain
    - (f) Organ size
  - 5. Easy Play Features
    - (a) Rhythm
    - (b) Chord rhythm
    - (c) Bass pattern
    - (d) Automatic bass
    - (e) Automatic chord
    - (f) Fill note
    - (g) Memory II. Interrupt Service Routine
- A. Input word from output FIFO
  - 1. Send MPX/$\overline{\text{READ}}$ line high
  - 2. Clear port causing strobe
  - 3. Input key word
- B. Decode key word
  - 1. Empty solo or accompaniment manual word
  - 2. Solo key closure or release
  - 3. Accompaniment key closure or release
  - 4. Pedal closure, release or empty scan
- C. Handle Solo Empty Scan word
- D. Handle Accompaniment Empty Scan word III. Solo Routine
- A. Keydown
  - 1. New Note
    - (a) Pick most stale unit
    - (1) available—continue
    - (2) not available
      - set busy flag
      - set busy signal
      - strobe FIFOs
      - return to mainline routine
    - (b) Remove unit from Queue
    - (c) Store note identity and keydown
    - (d) Clear busy flag and busy line and strobe FIFOs
    - (e) Transmit note with keydown and phase lock to solo unit
    - (f) Update brass if necessary
    - (g) Generate chimes fill notes if necessary
    - (h) Return to mainline program
  - 2. Old Note—already being played
    - (a) Already being played
      - (1) Store keydown internally
      - (2) Transmit note with keydown—no phase lock
      - (3) Update brass if necessary
      - (4) Generate chimes fill notes if necessary
      - (5) Clear BUSY flag and BUSY line and strobe FIFOs
      - (6) Return to mainline
    - (b) Key has been released
      - (1) Remove from middle of Queue
      - (2) Repeat steps 1–6 above (III.A 2a)
- B. Key Release
  - 1. Old Note—key identity matches one of the keyers
    - (a) Old note had keydown
      - (1) Remove keydown internally
      - (2) Install unit in queue
      - (3) Transmit update
      - (4) Clear BUSY flag and BUSY line and strobe FIFOs
      - (5) Release chime notes if necessary
      - (6) Reassign brass unit or release it
      - (7) Return to mainline
    - (b) Old Note was already released
      - (1) Was solo already busy?
        - if so, set BUSY LINE high
        - if not, clear BUSY LINE
      - (2) Strobe FIFOs
      - (3) Return to mainline
  - 2. New Key—not seen before
    - (1) Was solo unit busy before?
      - if so, set BUSY line
      - if not, clear BUSY line
    - (2) Strobe FIFOs
    - (3) Return to mainline IV. Accompaniment Section
- A. Non-Automatic Chord Mode
  - 1. Keydown
    - (a) New Note
      - (1) Pick most stale accompaniment unit
        - (A) Available
          - clear BUSY LINE
          - strobe FIFOs
        - (B) Not available
          - set BUSY LINE
          - set BUSY FLAG
          - strobe FIFOs return to mainline
(2) Remove accompaniment unit from Queue and store note with keydown internally
(3) Transmit note with keydown and phase lock information to Accompaniment keyers
(4) Calculate interpret chord root and minor information
(5) Update note pattern and bass pattern and make certain rhythm unit is running if memory is on
(6) Return to mainline
(b) Old note
(1) Already has keydown—continue
(2) No longer has keydown—been released
(A) Remove from middle of Queue
(B) Store keydown internally
(3) Clear BUSY line and strobe FIFOs
(4) Transmit note with keydown, but without phase lock
(5) Calculate interpreted chord root and minor information
(6) Update note pattern and bass pattern and make certain rhythm unit is running if memory is on
(7) Return to mainline
2. Key Release
(a) Old Note—key identity matches one of the keyers
(1) Remove keydown internally (2) Install unit in "Available" queue
(3) Clear BUSY flag, clear BUSY line and strobe FIFOs
(4) Transmit release
(5) Return to mainline
(b) New Key—not seen before
(1) Was accompaniment busy before?
if so, set BUSY line
if not, clear BUSY line
(2) Strobe FIFOs
(3) Return to mainline
B. Automatic Chord Mode
1. Keydown
(a) New Note
(1) BUSY
(A) Set BUSY line
(B) Set BUSY flag
(C) Strobe FIFOs
(D) Return to Mainline
(2) Not Busy
(A) Look up accompaniment notes to play, chord root and minor information
(B) Store notes internally
(C) Transmit notes
(D) Update note pattern and bass pattern and make sure rhythm unit is running if memory is on
(E) Return to mainline
(b) Old Note
(1) Was accompaniment busy before?
if so, set BUSY line
if not, clear BUSY line
(2) Strobe FIFOs
(3) Return to mainline
2. Key Release
(a) Old note
(1) Clear BUSY flag and BUSY line and strobe FIFOs
(2) Release notes internally
(3) If memory is not on then
transmit accompaniment key release
turn off note pattern
turn off bass pattern
(4) Return to mainline
V. Pedal Section
A. Pedal Down
1. BUSY
set BUSY line
set BUSY flag
strobe FIFOs
return to Mainline
2. Not BUSY
calculate pedal root
store internally
transmit pedal update unless automatic bass enabled
turn on rhythm unit if memory enabled
return to mainline
B. Pedal Release
1. Old Pedal
(a) Clear BUSY line and strobe FIFOs
(b) Store internally without keydown
(c) Transmit release if no automatic bass and no memory
2. New Pedal
(a) Was pedal busy before?
if so, set BUSY line
if not, clear BUSY line
(b) Strobe FIFOs
(c) Return to mainline
C. Empty Pedal Manual word
treat as OLD PEDAL RELEASE.

The following is the actual program itself set forth in hexadecimal notation:

```
0000=1A 20 DF B0 20 32 50 20 54 24 FF 94 FD 30 94 F8
0010=20 FF B0 29 09 7B FF FF FF FF FF FF FF FF FF FF
0020=1E 06 0A 07 65 6F 3C 20 64 B7 81 18 75 B6 B7 A0
0030=22 40 B0 45 15 24 03 B4 A0 21 BF B0 73 15 F5 14
0040=23 4B B4 03 0B 02 1D 1B 1C FF FF FF FF FF FF FF
0050=FF FF FF FF FF FF FF FF FF FF FF FF FF FF FF FF
0060=FF FF FF FF FF FF FF FF FF FF FF FF FF FF FF FF
0070=FF FF FF FF FF FF FF FF FF FF FF FF FF FF FF FF
0080=FF FF FF FF FF FF FF FF FF FF FF FF FF FF FF FF
0090=FF FF FF FF FF FF FF FF FF FF FF FF FF FF FF FF
00A0=1E 06 0A 07 65 6E 40 5E 41 5E 4B 5E 42 5E 08 2C
```

```
00B0=A0 21 7F B0 70 B4 A4 52 7F F2 25 0B 91 0E 73 15
00C0=E2 52 13 91 04 29 06 03 29 01 70 23 0F 84 07 29
00D0=05 07 29 09 AA A0 22 40 B0 B4 A0 22 80 B0 42 13
00E0=81 04 29 00 F4 66 6C 70 CC 81 03 18 5C 20 FE F3
00F0=53 29 09 AA 44 22 04 54 66 6D 44 21 40 94 04 3C
0100=94 F0 20 BC F4 54 20 FF 5C 71 50 67 6B 70 CC 81
0110=04 13 12 30 5E 8F F7 30 81 07 20 30 5A 28 0A C0
0120=67 6E 4C 13 12 5C 43 21 20 94 C7 66 6F 70 CC 81
0130=02 18 5C 50 28 04 E9 64 43 21 40 84 17 40 69 15
0140=24 09 5E 70 5C 64 69 A0 22 40 B0 4E B4 A0 21 BF
0150=B0 4C B4 6C 4C 22 07 13 12 5C 69 5E 74 15 5C 64
0160=69 A0 22 40 B0 4E B4 A0 21 BF B0 4C B4 29 09 AA
0170=43 21 10 84 04 29 03 EF 70 C2 91 04 29 03 80 20
0180=FB F4 54 66 6D 71 5C 44 21 01 84 04 29 03 74 67
0190=6B 42 EE 13 13 94 05 4D 29 03 1A 8F F5 4A 15 81
01A0=04 29 03 70 14 50 24 30 0B 4C 14 51 7F 15 FA C1
01B0=5A 15 81 04 70 18 5A 14 24 30 0B 15 91 05 4C 22
01C0=0F 5C A0 22 40 B0 B4 A0 22 80 B0 40 24 38 0B 42
01D0=5C 67 6B 73 51 4E E2 13 13 84 06 13 13 84 07 31
01E0=8F F4 78 90 04 7B E1 1F 15 64 68 5C 7F 15 E2 14
01F0=CC 5D 42 15 C0 24 05 5C 64 69 A0 22 40 B0 4E B4
0200=A0 21 BF B0 4C B4 67 6D 46 5E 47 5E 70 52 5B 56
0210=57 18 50 51 73 58 70 CC 81 1C 38 2A 0A 00 7F FC
0220=15 12 8E 16 F0 50 16 F1 51 42 8B 52 4B 8B 5B 46
0230=8B 56 47 8B 57 4E 8F DF 66 38 81 0B 40 F6 50 94
0240=0A 41 F7 51 94 12 64 29 02 E9 7C 5C 40 3C 13 81
0250=FD 40 F2 94 0E 90 0F 76 5C 41 3C 13 81 FD 41 FB
0260=84 04 4C 18 5C 64 6C 20 A7 81 03 20 E7 5C 69 5E
0270=20 40 5C 64 69 A0 22 40 B0 4E B4 A0 21 BF B0 4C
0280=B4 66 6F 70 CC 50 64 69 81 02 18 15 24 04 5D 4C
0290=68 5C 64 69 A0 22 40 B0 4E B4 A0 21 BF B0 4C B4
02A0=43 21 40 94 17 66 6E 4C 22 80 25 8C 94 03 78 15
02B0=E0 91 05 18 13 84 18 70 50 90 14 A0 22 40 B0 70
02C0=C0 81 02 18 15 24 09 B4 A0 21 BF B0 78 B4 64 6B
02D0=20 EF FC 5C 70 C0 70 81 03 71 15 EC 5C A0 22 40
02E0=B0 4C B4 A0 21 BF B0 70 B4 43 21 20 84 1F 44 21
02F0=80 84 1A 6D 4C 22 20 5C 7D CC 69 5E 70 5C 64 69
0300=A0 22 40 B0 4E B4 A0 21 BF B0 4C B4 43 21 10 94
0310=07 67 6D 4E 56 4C 57 29 04 E3 0A 51 70 CC 91 3B
0320=77 18 C1 0B 70 CC 50 81 0A 7F FA 5A 40 15 CA 5A
0330=90 0D 14 24 30 0B 7F 15 FC 5C 7F F0 CC 5C 40 15
0340=81 0B 7F 15 FA 5A 40 14 CA 5A 90 0D 14 24 30 0B
0350=7F FC 5C 7F 15 F0 CC 5C 41 0B 42 5C 77 F1 50 A0
0360=22 40 B0 B4 A0 22 80 B0 78 15 64 68 5C 29 01 EC
0370=44 22 01 54 A0 21 BF B0 B4 A0 22 80 B0 29 04 E3
0380=67 6B 42 EE 13 13 84 0E 8F F9 44 21 01 94 E6 A0
0390=22 40 B0 90 E4 4D 70 CC 81 F1 42 5C 66 0A 15 51
03A0=4A 14 22 F0 50 5C 4A 15 81 02 41 14 C1 5A 7F F0
03B0=24 30 0B 15 91 05 7F C1 FC 5C 20 FE F4 54 A0 22
03C0=40 B0 B4 A0 22 80 B0 90 03 90 A6 41 14 24 05 50
03D0=64 68 77 15 E2 14 5D 42 15 C0 5C 64 69 A0 22 40
03E0=B0 4E B4 A0 21 BF B0 4C B4 29 02 06 29 04 D2 70
03F0=C2 67 6E 81 7B EC 84 F5 81 D0 20 FB F4 54 42 5C
0400=A0 22 40 B0 B4 A0 22 80 B0 43 21 80 70 94 03 7F
```

```
0410=18 CC 13 13 12 25 46 91 D4 2A 0A 50 8E 8E 67 6B
0420=78 50 A0 22 40 B0 4C 15 C0 B4 A0 21 BF B0 73 15
0430=EC 14 B4 A0 22 40 B0 70 88 81 10 5C 15 C0 B4 A0
0440=21 BF B0 73 15 EC 14 24 80 B4 4E 30 8F D5 68 4C
0450=13 7F 91 0E FC 66 6F 1F 25 0C 94 02 70 5C 29 02
0460=65 FC 66 6F 1F 25 0C 94 02 70 18 5C 29 02 65 4C
0470=E2 13 13 94 5E 42 5C 20 FE F4 54 A0 22 40 B0 B4
0480=A0 22 80 B0 43 21 20 94 5B 67 6B 4C 13 12 5E 8F
0490=FB 28 04 E9 66 6F 70 CC 50 81 02 18 64 69 15 24
04A0=09 5E 70 5C 64 69 A0 22 40 B0 4E B4 A0 21 BF B0
04B0=4C B4 70 C0 6C 77 81 03 24 40 CC 13 12 69 5E 74
04C0=15 5C 64 69 A0 22 40 B0 4E B4 A0 21 BF B0 4C B4
04D0=90 12 44 21 01 84 04 29 03 74 A0 22 40 B0 B4 A0
04E0=22 80 B0 70 18 58 29 09 AA 67 6B A0 22 40 B0 70
04F0=CC 91 11 15 51 0A 24 CD C1 B4 A0 21 BF B0 73 15
0500=EC 14 B4 4E 8F E6 1C 67 6F 42 23 6D 84 19 81 29
0510=42 EC 91 27 84 25 44 22 08 54 A0 21 BF B0 B4 A0
0520=22 80 B0 29 09 AA 64 3C 84 07 A0 22 40 B0 90 EF
0530=20 FF 5C 67 4C 13 12 52 90 7F A0 22 40 B0 B4 A0
0540=22 80 B0 70 64 5C 67 72 E2 50 42 5C 13 14 E0 15
0550=14 24 7D 66 6E 5C 43 21 40 94 C9 4D 50 25 8C 94
0560=03 78 15 EC 64 6B 91 0B 18 13 94 07 4C 22 10 5C
0570=90 05 20 EF FC 5C A0 22 40 B0 4C B4 A0 21 BF B0
0580=70 B4 A0 22 40 B0 40 15 24 09 B4 A0 21 BF B0 40
0590=14 B4 43 21 20 84 1F 44 21 80 84 1A 6D 4C 22 20
05A0=5C 7D CC 69 5E 70 5C 64 69 A0 22 40 B0 4E B4 A0
05B0=21 BF B0 4C B4 29 09 AA 42 EC 13 84 17 44 21 08
05C0=94 07 A0 22 40 B0 90 05 A0 21 BF B0 B4 A0 22 80
05D0=B0 90 E3 42 5C A0 22 40 B0 B4 A0 22 80 B0. 66 6E
05E0=7F FC 5C 43 21 40 94 CE 64 6B 72 15 FC 84 06 43
05F0=21 20 94 C2 66 6E 4C 15 24 09 B4 A0 21 BF B0 70
0600=B4 90 B3 70 C2 91 07 13 91 1B 29 07 D9 66 6C 70
0610=CC 91 03 18 5C 43 21 04 84 0B 42 21 3F 25 17 91
0620=04 29 07 EB 63 6F 4D 4C E2 13 13 84 67 8F F8 43
0630=21 01 84 04 29 07 54 46 15 81 04 29 06 A2 7F F6
0640=50 24 10 0B 4C 14 51 7F 15 F6 C1 56 15 81 04 70
0650=18 56 14 24 10 0B 15 91 05 4C 22 0F 5C 40 24 18
0660=0B 42 5C 63 6C 70 51 4E E2 13 13 84 06 13 13 84
0670=08 31 8F F4 78 15 90 06 7B C1 15 24 08 64 68 5C
0680=73 15 F2 14 23 03 CC 5D 42 15 C0 5C 43 22 02 53
0690=29 07 6C 0A 24 E3 51 44 21 10 94 04 29 06 DA 29
06A0=09 16 47 15 81 04 29 07 4E 14 50 24 10 0B 4C 14
06B0=51 7F 15 F7 C1 57 15 81 04 70 18 57 14 24 10 0B
06C0=15 91 05 4C 22 0F 5C 40 24 18 0B 42 5C 20 48 64
06D0=68 5C 74 18 C0 91 9E 50 90 A7 7C 15 FC 94 55 C1
06E0=91 08 46 15 91 04 29 06 3E 41 24 15 0B 70 CC 50
06F0=81 11 70 C1 6F 81 02 6E 60 7F FC 5C 40 15 CC 5C
0700=90 0D 14 24 10 0B 7F 15 FC 5C 7F F0 CC 5C 40 15
0710=81 12 70 C1 6F 81 02 6E 60 7F 15 FC 5C 40 14 CC
0720=5C 90 0D 14 24 10 0B 7F FC 5C 7F 15 F0 CC 5C 41
0730=24 1D 0B 42 FC E2 EC 5C 70 C1 50 20 48 64 68 5C
0740=91 04 29 06 80 75 C1 50 78 15 5C 29 06 80 43 22
0750=01 53 70 58 43 21 08 94 18 A0 21 BF B0 42 13 81
0760=04 29 08 ED B4 A0 22 80 B0 29 08 ED 20 FE F3 53
0770=A0 22 40 B0 42 13 81 04 29 08 ED B4 A0 22 80 B0
```

```
0780=43 21 04 84 17 2A 0A E0 7F F2 13 13 8E 65 6A 7C
0790=15 E2 88 5E 8F FD 73 58 29 08 ED 42 18 C5 91 04
07A0=29 08 ED 45 51 42 55 65 6F 70 CC 78 5C 20 64 B7
07B0=20 4F B6 81 22 64 69 A0 22 40 B0 4E B4 A0 21 BF
07C0=B0 4C B4 73 50 20 40 64 68 5C 73 15 F1 14 23 03
07D0=CC 5D 41 15 C0 5C 29 08 ED 63 6F 4D 4C E2 13 13
07E0=84 25 8F F8 70 E8 91 04 29 08 ED 43 21 01 94 0D
07F0=A0 22 40 B0 B4 A0 22 80 B0 29 08 ED 43 21 08 94
0800=F0 A0 21 BF 90 EE 78 15 E2 50 7C 15 FC 84 D6 70
0810=E8 40 81 04 7C 15 E0 FC 5C E2 94 C9 44 21 10 84
0820=04 29 09 5A 62 0A 15 51 25 40 47 91 02 46 14 22
0830=F0 50 5C 41 60 6F 25 40 91 02 6E 4C 15 81 02 41
0840=14 C1 5C 7F F0 24 10 0B 15 91 05 7F C1 FC 5C 41
0850=14 24 FB 50 20 40 81 05 41 14 50 70 64 68 5C 73
0860=15 F2 14 23 03 CC 5D 42 15 C0 5C 43 22 02 53 20
0870=FE F3 53 A0 22 40 B0 70 C8 81 73 B4 A0 22 80 B0
0880=43 21 04 84 14 2A 0A E0 7F F2 13 13 8E 65 6A 42
0890=88 5E 8F FD 73 58 90 56 78 15 E5 E2 94 50 64 69
08A0=A0 22 40 B0 4E B4 A0 21 BF B0 4C B4 63 6F 78 15
08B0=55 4C 18 91 06 C5 4C 81 02 55 4E 8F F5 78 15 E5
08C0=65 6F 75 B6 B7 94 07 70 CC 81 36 90 0D 70 CC 7A
08D0=5C 20 64 B7 20 8F B6 81 28 20 40 64 68 5C 73 50
08E0=15 F2 14 23 03 CC 5D 42 15 C0 5C 90 06 43 21 02
08F0=84 13 64 69 A0 22 40 B0 4E B4 A0 21 BF B0 4C B4
0900=20 FD F3 53 38 91 0A 20 28 C8 0B 4C 52 29 06 03
0910=70 18 58 29 09 AA 7C 15 FC 84 04 29 07 33 41 24
0920=15 0B 70 CC 50 81 0A 7F F7 57 40 15 C7 57 90 0D
0930=14 24 10 0B 7F 15 FC 5C 7F F0 CC 5C 40 15 81 0C
0940=7F 15 F7 57 40 14 C7 57 29 07 2F 14 24 10 0B 7F
0950=FC 5C 7F 15 F0 CC 5C 29 07 2F 62 0A 15 51 47 14
0960=22 F0 50 5C 47 15 81 02 41 14 C1 57 7F F0 24 10
0970=0B 15 91 05 7F C1 FC 5C 29 08 4F 67 6F 70 5E 8F
0980=FD 0A 24 F8 0B 81 F7 20 40 56 20 75 57 2A 0A C7
0990=28 0A 87 73 15 5A 28 0A C0 64 6B 20 0A 5C 67 6F
09A0=20 6C 5C 78 15 55 59 29 0B 10 65 6E 4E 50 4E 51
09B0=4E 5B 4E 52 03 0B 02 1D 2C 1B 0C F6 75 64 53 42
09C0=31 20 1F 47 07 10 C1 90 05 10 98 90 05 90 04 22
09D0=23 15 07 25 9F 00 22 A0 21 AF 07 A0 21 0C 0C 0C
09E0=2C 48 6C 80 E0 AC 6C C4 AC 0C 04 47 47 07 05 9F
09F0=00 C1 00 98 80 26 80 05 80 04 02 23 00 22 40 44
0A00=32 1C 20 00 00 04 00 00 64 38 40 00 00 08 00 08
0A10=48 72 00 02 00 10 00 00 12 66 00 04 00 20 00 00
0A20=26 4C 00 08 00 40 00 00 4E 18 00 10 02 00 00 00
0A30=1C 32 00 20 04 00 00 00 38 64 00 40 08 00 00 00
0A40=72 48 02 00 10 00 00 00 66 12 04 00 20 00 00 00
0A50=4C 26 08 00 40 00 00 00 18 4E 10 00 00 02 00 00
0A60=00 A3 9B D8 9B 98 95 A1 00 A1 9A 96 99 96 A3 9B
0A70=00 9B 98 A4 00 94 A1 99 94 A1 9A 96 00 96 A3 9B
0A80=F2 31 20 1F FF FF FF 62 6F 16 5E 8F FD 1C FF FF
0A90=96 A3 A0 98 00 98 94 E1 00 99 96 A2 00 9A 97 A3
0AA0=00 9B 97 E4 00 95 A2 9A 00 A1 99 D6 00 A2 9B 97
0AB0=00 A2 9A D7 00 94 A0 D9 00 95 A1 DA 00 96 A2 DB
0AC0=2A 0A 80 66 6B 90 C3 F6 75 6F F3 42 31 20 1F FF
0AD0=00 97 A4 A0 00 97 A3 E0 00 99 95 E2 00 9A 96 E3
0AE0=F7 F9 F4 00 F7 F9 F4 00 F7 F9 F4 00 F7 F9 F4 00
```

```
0AF0=F7 F9 F4 00 FB F5 F4 00 FB F5 F4 00 FB F5 F4 00
0B00=FB F5 F8 00 FB F5 F8 00 FB F5 F8 00 FB F5 F8 00
0B10=64 6E A0 18 21 A0 84 04 29 00 00 74 CC B1 70 B5
0B20=5B 76 51 A5 84 25 91 2E 3B 13 91 2A 31 81 FA 70
0B30=5C 43 21 80 94 12 44 21 80 84 0D 1A 20 7F F4 22
0B40=40 54 20 DF F3 53 1B 29 0B C9 77 18 5B 78 CC B1
0B50=73 51 A5 81 D4 44 21 80 94 13 1A 44 22 80 54 43
0B60=21 80 94 09 44 22 40 54 20 DF F3 53 1B 4B 18 1F
0B70=50 2A 09 DD 40 8E 16 5B 64 6B 20 3F 1A FC 5C 4B
0B80=15 EC 5E 1B 4B 14 23 40 5C 5B 66 6F 1A A0 22 40
0B90=B0 70 CC 81 02 18 15 24 04 B4 A0 21 BF B0 4B B4
0BA0=A0 22 40 B0 40 15 24 0B B4 A0 21 BF B0 70 B4 1B
0BB0=64 6E 78 CC B1 2A 09 C3 40 13 8E 16 5B 16 52 73
0BC0=15 FB 14 5C A5 15 13 91 60 71 15 CC B1 2A 09 EA
0BD0=76 51 A5 50 66 6C 81 11 43 21 04 94 34 1A 70 CC
0BE0=91 15 43 22 04 53 90 29 43 21 04 84 0A 1A 70 CC
0BF0=91 1F 20 FB F3 53 1B 64 6E 40 2A 09 EC 13 50 16
0C00=91 13 16 40 31 81 F7 72 15 CC B1 72 51 A5 90 0B
0C10=1B 64 6E 16 5B 16 52 90 10 13 50 16 91 F7 16 40
0C20=31 81 F7 13 14 5B 77 52 74 15 CC B1 2B 71 15 F2
0C30=84 0E 64 6D 72 15 FC 94 07 20 2F F2 22 C0 52 A5
0C40=50 70 C1 81 23 40 13 13 81 09 42 13 12 22 40 52
0C50=90 0A 13 81 07 42 21 3F 22 80 52 70 C0 91 1C 13
0C60=91 12 A0 22 18 90 19 70 CB 91 10 13 91 06 A0 22
0C70=18 90 0D A0 22 10 21 F7 90 06 A0 21 EF 22 08 B0
0C80=78 F0 64 6D 1A 94 06 20 BF FC 90 04 4C 22 40 5C
0C90=A0 22 40 B0 7D EC B4 A0 21 BF B0 70 B4 1B 74 F0
0CA0=1A 43 94 05 21 7F 90 03 22 80 53 1B 64 6E 78 15
0CB0=CC B1 4B 15 5B 1A A0 22 40 B0 7E CB B4 A0 21 BF
0CC0=B0 70 B4 A0 22 40 B0 75 CB B4 A0 21 BF B0 74 15
0CD0=B4 1B 77 F2 50 A0 21 F8 E0 B0 78 F2 13 50 64 6D
0CE0=20 EF 1A FC E0 5C 1B 42 14 15 52 91 10 13 81 0D
0CF0=1A 44 21 10 94 0D 44 22 20 54 90 07 1A 44 21 10
0D00=94 F5 20 F7 F3 53 7C 15 E2 94 05 43 22 08 53 A0
0D10=22 40 B0 7C E2 B4 A0 21 BF B0 70 B4 A0 22 40 B0
0D20=76 E2 B4 A0 21 BF B0 74 15 B4 1B A5 64 6B 21 20
0D30=94 23 72 15 1A FC 84 1D 43 21 40 94 15 66 6E A0
0D40=22 40 B0 70 CC 91 0B 15 24 09 B4 A0 21 BF B0 70
0D50=B4 64 6B 70 24 0A 50 20 D0 1A FC E0 5C A0 22 40
0D60=B0 4C B4 A0 21 BF B0 70 B4 1B A5 13 21 80 50 6D
0D70=20 7F 1A FC E0 5C 1B 66 6E A5 15 20 8F 50 81 22
0D80=43 21 10 94 48 44 21 04 84 45 1A 44 22 40 54 43
0D90=21 40 94 05 4D 13 12 5E 43 22 50 21 DF 53 1B 90
0DA0=2C 43 21 10 84 10 44 21 04 84 7A 1A 43 21 CF 53
0DB0=44 22 40 54 1B A5 12 15 7F 50 81 15 43 21 40 94
0DC0=63 74 15 1A E3 53 4C 13 12 51 90 44 90 57 90 52
0DD0=43 21 40 84 4F 1A 70 CD 51 5B 91 09 70 CE 81 02
0DE0=18 51 5D 4B 22 80 25 8C 94 03 78 15 EC 64 6B 91
0DF0=0B 18 13 94 07 4C 22 10 5C 90 05 20 EF FC 5C A0
0E00=22 40 B0 4C B4 A0 21 BF B0 70 B4 20 BF F3 53 A0
0E10=22 40 B0 41 15 24 09 B4 A0 21 BF B0 41 14 B4 90
0E20=03 7F 50 1B A5 15 13 70 81 09 43 21 04 70 94 03
0E30=74 15 C0 50 1A A0 22 40 B0 40 B4 A0 21 BF B0 70
0E40=B4 1B A5 21 02 94 04 29 0E CC 43 21 20 94 50 44
```

```
0E50=21 02 94 06 44 21 40 94 46 1A 20 FD F4 54 43 22
0E60=20 53 1B 44 21 04 84 41 43 21 40 94 06 67 6F EC
0E70=91 37 64 6D 20 5F 1A FC 5C 1B 6C 1A A0 22 40 B0
0E80=74 15 FC 23 07 5C B4 A0 21 BF B0 74 15 B4 A0 22
0E90=40 B0 72 15 EC 5C B4 A0 21 BF B0 74 15 B4 70 C9
0EA0=81 03 75 B6 1B 29 0E ED 44 21 80 84 C6 64 6C 1A
0EB0=A0 22 40 B0 4C 22 27 5C B4 A0 21 BF B0 74 15 B4
0EC0=1B 6D 72 15 50 1A FC E0 EC 5C 90 D3 43 21 20 84
0ED0=13 1A 20 DF F3 53 44 22 40 54 44 22 02 54 64 6F
0EE0=71 5C 1B A5 91 C3 43 21 80 94 88 90 BC 66 6C 70
0EF0=1A CC 81 05 1B 29 0B 10 25 08 84 5F 24 18 0B 71
0F00=50 7C 15 FC 4C 84 05 30 21 3F 5C 15 51 A0 22 40
0F10=B0 0A 24 E3 91 07 C1 B4 74 15 90 06 24 05 C1 B4
0F20=70 51 A0 21 BF B0 73 15 EC 14 C1 B4 44 21 20 94
0F30=4E 30 81 1C 44 21 10 94 0B 74 15 56 2A 0A C7 20
0F40=75 90 09 2A 09 BB 70 18 56 77 15 57 2B 0A 87 66
0F50=6C 3C 81 03 78 5C 1B 29 0B 10 20 40 64 68 5C 73
0F60=50 15 F5 14 E0 CC 5D 45 15 C0 5C 78 15 55 64 69
0F70=A0 22 40 B0 4E B4 A0 21 BF B0 4C B4 90 D2 71 15
0F80=E4 21 DF 54 12 15 91 BC 90 B0 FF FF FF FF FF FF
0F90=FF FF FF FF FF FF FF FF FF FF FF FF FF FF FF FF
0FA0=FF FF FF FF FF FF FF FF FF FF FF FF FF FF FF FF
0FB0=FF FF FF FF FF FF FF FF FF FF FF FF FF FF FF FF
0FC0=FF FF FF FF FF FF FF FF FF FF FF FF FF FF FF FF
0FD0=FF FF FF FF FF FF FF FF FF FF FF FF FF FF FF FF
0FE0=FF FF FF FF FF FF FF FF FF FF FF FF FF FF FF FF
0FF0=FF FF FF FF FF FF FF FF FF FF FF FF FF FF FF FF
```

Figure 8:
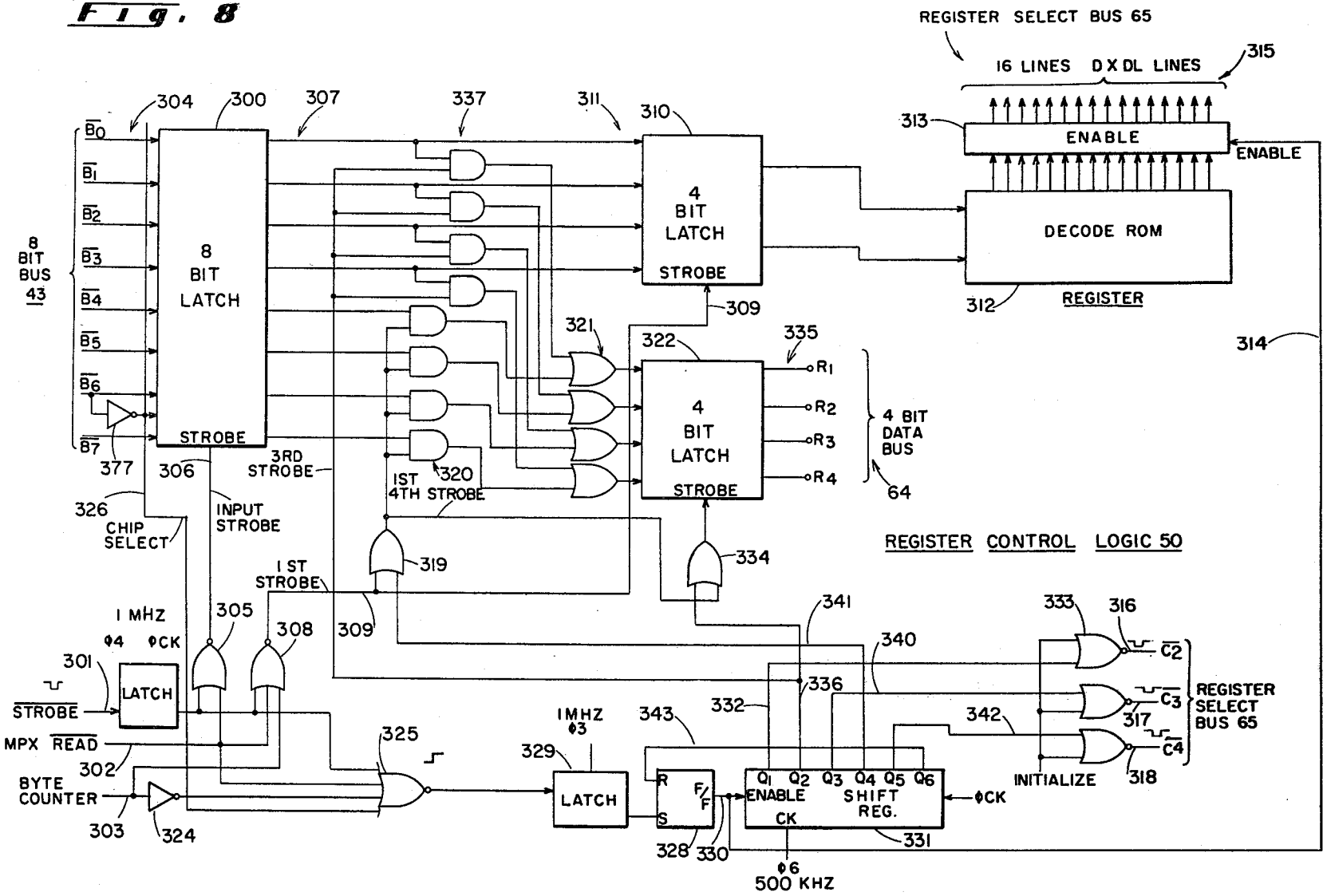
FIG. 8 is a schematic of one of the register control logic blocks.

FIG. 8 shows register control logic block 50 for the accompaniment section, which block is substantially identical to register control logic blocks 51, 52 and 53. The purpose of this circuit is to route the keydown, pitch, octave and other control data on the eight bit bus 43 to the appropriate accompaniment units 60, 61, 62 or 63 and to the appropriate register or latch within that unit. Microcomputer 41 is programmed to select an available accompaniment unit 60–63 for production of the tone selected by a depressed key of the accompaniment manual 31 and to select the attack and sustain characteristics as well as phase locking and keydown information.

Eight bit data bus 43 is connected to the inputs of an eight bit latch 300, which inputs are denoted $B\overline{0}$ $B\overline{7}$. Also connected to block 50 is the inverted strobe signal on line 301, the MPX/$\overline{\text{READ}}$ signal on line 302, and the byte counter signal on line 303, these last three lines being indicated generally as lines 47 in FIG. 1A. Since the data is sixteen bits wide, it is necessary to input it as two eight bit bytes through latch 300. Microcomputer 41 causes the MPX/$\overline{\text{READ}}$ line 302 to go low indicating that the microcomputer is going to send information, the byte counter line 303 then goes low indicating that the first eight bit byte is to be sent, the first eight bit byte is placed on the inputs 304 of latch 300, and strobe line 301 then pulses low causing NOR gate 305 to activate since both of its inputs are low, thereby placing an input $\overline{\text{strobe}}$ pulse on line 306 and latching the data on the inputs 304 of latch 300 to its outputs 307.

NOR gate 308 is also activated at this time, and its output 309 is connected to the strobe input of four bit latch 310 and sends the four bits of data on its inputs 311 into decode ROM 312. ROM 312 decodes the four bit binary word and, when enable block 313 is enabled by a signal on line 314, one of the sixteen output lines 315 is enabled. Lines 315, which are referred to as the $\overline{\text{DXDL}}$ lines, are part of the register select bus, and together with the $\overline{\text{C2}}$ line 316 the $\overline{\text{C3}}$ line 317 and the $\overline{\text{C4}}$ line 318 select an appropriate latch within the accompaniment keyer block to which the data is to be sent. The originations of the signals on lines 316, 317 and 318 will be described below.

The first strobe pulse on line 309 passes through OR gate 319 and enables AND gates 320 to connect the second four bits of data on the output of latch 300 through OR gates 321 into four bit latch 322. Next, the strobe pulse terminates and the byte counter line 301 then goes to logic 1 thereby indicating that the next group of eight bits is coming in from microcomputer 41. This second eight bit byte is connected to the inputs 304 of latch 300, and since the MPX/$\overline{\text{READ}}$ line remains at a logic 0 and the strobe line 301 pulses to a logic 0, latching occurs and the second eight bit word is loaded into latch 300 and appears on its output lines 307. During receipt of the second eight bit byte, byte counter line 303 is in a logic 1 and that is inverted by inverter 324 and places a logic 0 at one of the inputs of NOR gate 325. Additionally, the MPX/$\overline{\text{READ}}$ line 302 and the $\overline{\text{strobe}}$ line 301 are at logic 0 together with the chip select line 326, which indicates whether the data is for this chip and is programmably connected through inverter 377 to the $\overline{\text{B6}}$ line from microcomputer 41. All of this causes the output of NOR gate 325 to go to a logic 1 thereby setting flip-flop 328 through latch 329. The output 330 of flip-flop 328 is connected to the enable input of a six bit shift register 331. The Q1 output 332 of shift register 331 is then enabled at phase 6 thereby activating the $\overline{C2}$ line 316 through NOR gate 333. Since the lower four bit latch 322 has already been strobed by the first strobe pulse through OR gate 334, the lower portion of the first eight bit word is present at the outputs 335 of four bit latch 322. By way of example, this four bit data word represents the pitch of the note which is to be played by the captured accompaniment unit 60, 61, 62 or 63, and the $\overline{C2}$ signal on line 316 enables the appropriate note information latch within the captured accompaniment unit 60 to latch the four bit data at that time. The signals on lines 316, 317 and 318 are gated together with the $\overline{DXDL}$ lines 315 as by a NOR gate, for example, the output of which selects one of the latches within a particular accompaniment keyer block. Assuming that the $\overline{DXDL}$ line 315 that is activated selects one of the accompaniment units 60–63, the latch within that unit that is connected to the $\overline{C2}$ line 316 will be latched at the time of the $\overline{C2}$ pulse.

When the Q2 output 336 of shift register 331 next activates, it enables AND gates 337 to connect the four bit data word on the top four lines of latch 300 through OR gates 321 to the inputs of the lower four bit latch 322. At the same time, latch 322 is strobed so that the top four bit nibble of the second eight bit word is latched to the outputs 335 of latch 322 onto the four bit data bus 64. Next, the Q3 output 340 activates thereby placing the $\overline{C3}$ pulse on output line 317. This line is gated with one of the $\overline{DXDL}$ lines 317 to another latch within the captured accompaniment unit 60–63, and latches in the new data that is now on the outputs 335 of four bit latch 322 connected to the four bit data bus 64. This data, for example, causes phase locking to be enabled and contains the octave information for the note to be played, which is encoded as a two bit binary word.

Next, the Q4 output 341 activates thereby enabling AND gates 320 to place the lower four bit byte on the inputs of latch 322 and strobes latch 322 to place this four bit byte on its outputs 335. This data, for example, contains the keydown on/off information, enables the chip, and selects which of the other accompaniment units 60–63 to which the captured accompaniment unit is to be phaselocked. Next, the Q5 output 342 activates to produce the $\overline{C4}$ pulse on line 318, which is gated with the appropriate $\overline{DXDL}$ line 317 to a latch within the captured unit, and causes the last four bits of data to be latched. Finally, the Q6 output 343 activates, thereby resetting flip-flop 328. The register control logic block 50 is now ready to receive a new sixteen bit data word from microcomputer 41. The other register control logic blocks 51, 52 and 53 function similarly, although the type of data which they transmit to the various blocks in the system controlled by them will vary, and the programming of microcomputer 41 determines what the data interfaced by them will be.

Referring now to FIGS. 9, 10 and 11, solo unit 116 will be described in detail. Solo unit 116 is identical to solo units 117, 118, 119 and 120 and very similar to solo units 142–144, except that the latter do not include phase locking.

Solo unit 116 comprises a bank of latches 345 having as their inputs data bus 121 and register select bus 122 from the appropriate register control logic block 53, which is substantially identical to register control logic block 50 shown in detail in FIG. 8. As discussed earlier, latches 345 comprise a plurality of individual latches 346 (FIG. 10) which are activated by the $\overline{C2}$ signal, for example, on line 347 and the $\overline{DXDL}$ signal 348 on line 348 by NOR gate 349. The output of NOR gate 349 activates the appropriate latch, such as the pitch word latch 346, so that the pitch word information on data bus 121 is latched to its outputs 350 at the appropriate time. It will be recalled that data bus 121 carries three four bit bytes in succession, and this is the reason for the phase difference between the $\overline{C2}$, $\overline{C3}$ and $\overline{C4}$ enabling signals.

One of the outputs 350 of latches 345 is the four bit pitch word, which is connected to the input of latch 351 clocked by the keydown enable signal on line 352 from the output 354 of keydown enable block 353. The solo unit 116 must be ready to accept the new pitch word so it waits for the keydown enable signal from block 353 in order to actually place the four bit pitch word on the inputs 355 of solo top octave synthesizer (TOS) 356, which is driven by the two megahertz signal on line 357. Keydown enable block 353 gates together the keydown signal on line 358 from one of the other latches 345 together with the keydown enable signal on line 359 from Z receiver demultiplexer 360, which occurs when phase locking is complete.

Figure 12:
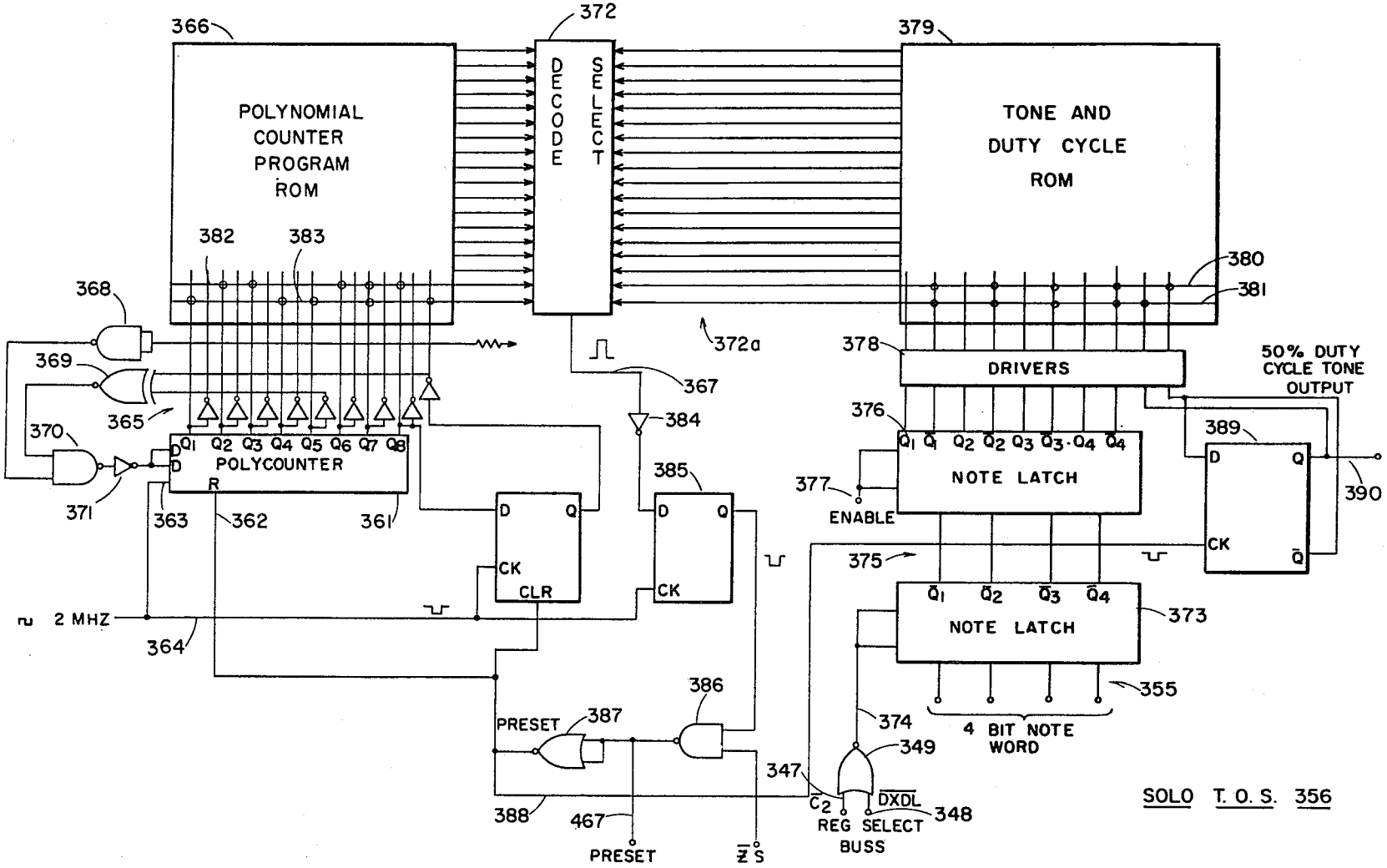
FIG. 12 is a schematic of the solo top octave synthesizer.

FIG. 12 illustrates the top octave synthesizer 356. It comprises a 74164 polynomial counter 361 having a reset input 362, a clocking input 363 connected to the two megahertz clocking input 364, and outputs 365. Outputs 365 are connected to a polynomial counter programming read only memory 366 which, as is conventional, decodes the outputs 365 to produce a reset signal on line 367 when the state for the particular desired frequency is decoded. It comprises an anti-lockup gate 368 and a feedback gate 369 are connected back to the D input of shift register 361 through NAND gate 370 and inverter 371. The feedback and anti-lockup circuitry is conventional with polynomial counters, and the programming of read only memory 366 is well within the skill of those familiar with such counters in order to produce on the selected output line the desired frequency.

The four bit note word is connected by lines 355 to the inputs of note latch 373, which is enabled by the gated $\overline{C2}$ and $\overline{DXDL}$ signals at the output 374 of NOR gate 349. The outputs 375 of latch 373 are connected to the inputs of a further latch 376, which is enabled by an internally generated enable signal on line 377 when the solo unit in question is ready to have the TOS updated. For example, if phase locking is occurring, it must be completed before the tone polycounter 361 starts running at the new frequency. The outputs of latch 376 are connected to drivers 378, the outputs of which are the address lines for tone and duty cycle read only memory 379. The outputs 372 of read only memory 379 are enable lines connected to the decode select block 372, and function to enable the correct polycounter program decode lines and send the decode pulse onto line 367 to generate the desired frequency. Because some frequencies require division by odd numbers, for example, 239, a toggling technique is utilized to produce a reset pulse after a count of 120 and then after a subsequent count of 119, in the example given. For example, the lowest two lines 380 and 381 of tone and duty cycle ROM 379 are connected to enable the bottom two lines 382 and 383 of program ROM 366 when selected in decode select block 372. If line 381 is activated, decode select block 372 will select line 383 of ROM 366, and polycounter 361 will run until decoded by the corresponding line 383 in ROM 366, which produces a pulse on line 367 at the input of inverter 384, and that is clocked through flip-flop 385, NAND gate 386 and inverter 387 over line 388 to the clocking input of D-type flip-flop 389. This toggles flip-flop 389 to then activate line 380 in ROM 379, thereby enabling corresponding line 382 by means of decode select block 372, which causes polycounter 361 to be reset on a different count. The decoding for one of the lines 382 and 383 is selected for count 120, in this example, and the other for count 119. The net result of this is to produce a division by 239 in order to obtain the frequency selected by the four bit note word on the input 355 of latch 373. A similar technique can be used for other divisors. This technique is not necessary for division by even numbers, although it is necessary for odd numbers because of the inability to produce odd divisions utilizing only one line of polynomial counter ROM 366.

Figure 13:
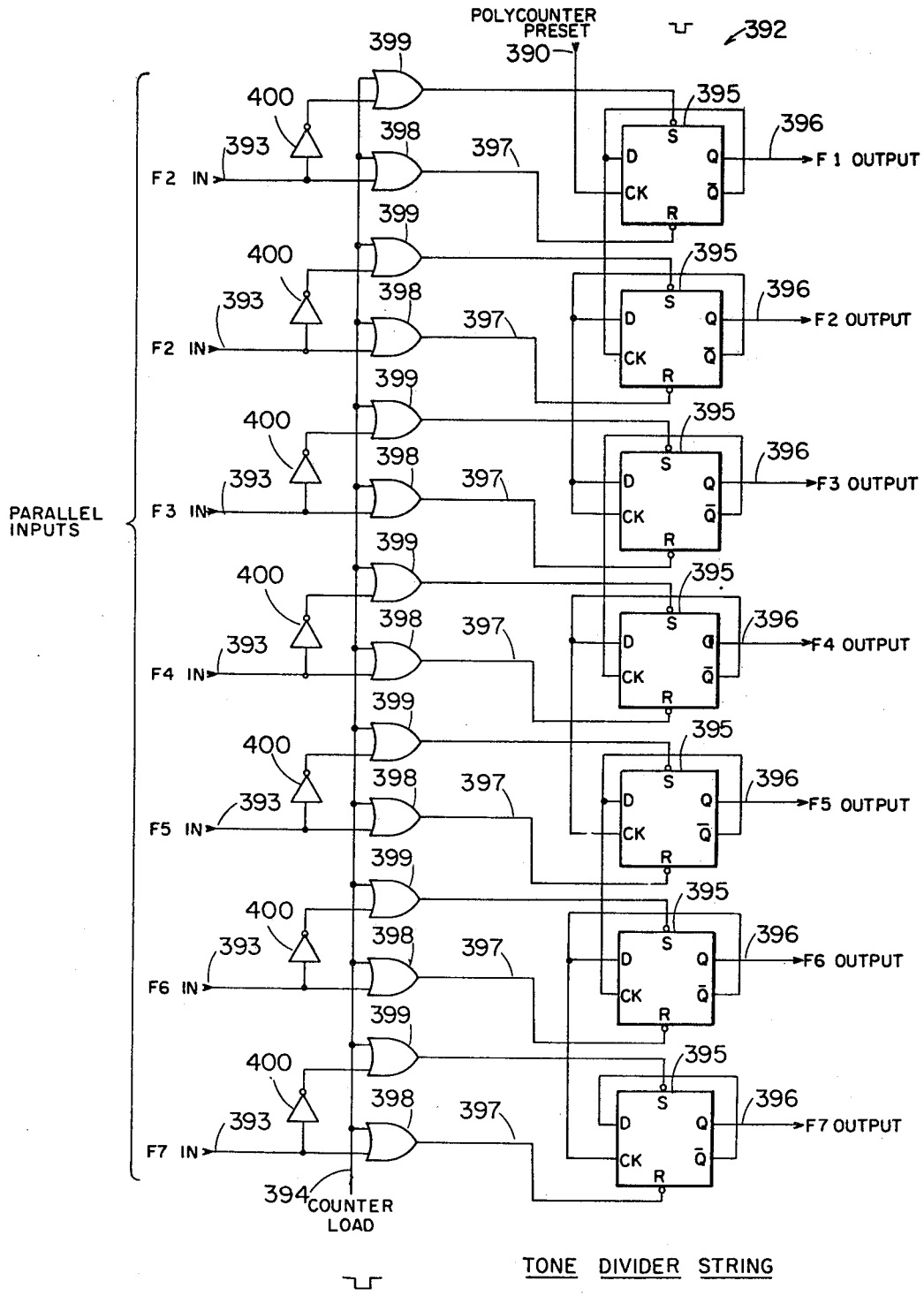
FIG. 13 is a schematic of the tone divider string of FIG. 9.

Returning now to FIG. 9, the output 390 of solo TOS 356 is connected by line 391 to a string of solo tone dividers 392, which have inputs 393 from the Z receiver demultiplexer 360 as well as a load signal on line 394 from the Z receiver demultiplexer 360. FIG. 13 illustrates the solo tone divider string 392 in detail and will be seen to comprise a plurality of D-type flip-flops 395 with the polycounter preset tone line 390 connected to the clocking input of the first flip-flop 395 and the $\overline{Q}$ outputs of each flip-flop connected to the clocking input of the next flip-flop 395. The $\overline{Q}$ outputs 396 carry the input tone divided by factors of two so that the tones lie in respective octaves.

The reset inputs for each of flip-flops 395 are connected to the outputs 397 of OR gates 398, and the set inputs are connected to the outputs of OR gates 399. OR gates 398 are connected to the outputs 393 of Z receiver demultiplexer, and OR gates 399 are connected thereto through inverters 400. Normally, the dividers 395 operate as a normal binary divider string, however, when the counter load signal on line 394 goes low, the outputs 396 follow their respective inputs 393. When the counter load signal disappears, binary counting continues from the count which was just loaded via inputs 393.

Outputs 396, which are octavely related tones having the pitch produced by solo TOS 356, are connected to the inputs of tone select ROM 401, which selects the octaves controlled by the octave and footage signals on lines 402 and 403 connected to selected latches 345. The octave footage information is determined by microcomputer 41 and transmitted through latches 345 in a fashion similar to that in which the pitch information was transmitted. The selected output tones on lines 404 are connected to conventional FET keyers 405 (FIG. 11), which impart a characteristic envelope under the control of the envelope signal on line 406. The output tones on outputs 407 for the seven flute footages, a sixteen foot square wave and eight foot staircase have amplitude envelopes characteristic of the particular voicing and instrument selected by tabs 54 and transmitted to solo keyer unit 116 by microcomputer 41 through register control logic block 53, as will be described in greater detail hereinafter.

Latches 408 (FIG. 11) have as their inputs the data bus 121 and register select bus 122 from register control logic 53 and, in a manner similar to the functioning of latches 345 for the pitch word, produce on their outputs various control signals. On line 409 is the percussion on/off signal, which is connected to one of the inputs of ADSR envelope control circuit 410. Line 411 carries the attack information for the keying envelope, whether the attack is to be a fast attack or a slow attack, again depending on the voicing selected. Lines 412 carry the binary code for the sustain, whether long, short or percussion.

Lines 411 and 412 are connected to a bank of programmable dividers 413, that are driven by a one megahertz signal on line 414 and produce on line 415 the attack clock, on line 416 the sustain clock, and on line 417 the decay/release clock, the latter being used for snubbing as in the case of piano tones wherein a more rapid decay is necessary for the ADSR envelope. A typical ADSR envelope is illustrated in FIG. 14 and will be seen to have an attack portion A, a decay portion D, a sustain portion S and a release portion R when the key is released. An attack/decay counter 418 determines at what point the attack clock is switched off and the sustain clock is switched on, and then when the sustain clock is switched off and the decay/release clock is switched on. ADSR envelope control block 410 produces on output line 419 the selected attack or decay clock, and on line 420 a DC level indicating whether the system is in attack or decay.

Lines 419 and 420 are connected to a charge pump 421 or a bank of charge pumps shown generally in FIG. 15. This type of charge pump for generating the attack and decay envelope for the ADSR envelope is disclosed in greater detail in U.S. Pat. No. 4,205,582 which is expressly incorporated herein by reference. The charge pump 421 comprises a pair of capacitors 422 and 423, and a pair of electronic switches 424 and 425 connected in series with each other between the input terminal 420 and the output terminal 406. The attack/decay clock signal on line 419 alternately opens and closes switches 424 and 425, which are actually field effect transistors, to thereby incrementally transfer the voltage on input 420 to output 406. During attack, ADSR envelope control 410 will place a logic 1 or high DC level on input 420 so that the voltage on output 406 increases incrementally and exponentially from the initial voltage to the voltage on input 420. After a certain number of counts of counter 418, it will trigger ADSR envelope control 410 to place a logic 0 on output 420 and to now select the decay clock frequency on input 417. This will cause the voltage on output 406 of charge pump 421 to decrease exponentially and incrementally until the next count is reached by counter 418. At that point, the sustain clock signal on line 416 will be connected to input 419 of charge pump 421 and a more gradual sustain will result as shown in FIG. 14. If the key is released, then the keydown signal on line 422 will cause ADSR envelope control to again connect the decay clock train on line 417 so that the decay occurs more rapidly due to the more rapid switching of switches 424 and 425. The output 406, which is the ADSR envelope or a sustain type envelope, controls the amplitudes of the tones produced at the outputs 407 of keyers 405.

The gating circuitry within ADSR envelope control 410 can be relatively simple, and may take the form of a data selector. For example, the various counter outputs from counter 418 can be connected to individual gates also having connected to their inputs the attack, sustain and release clocking inputs 415, 416, and 417, and the percussion on/off signal on line 409 can connect between two separate banks of gates, depending on whether the envelope is to be of the percussive or sustain type. Charge pump 421, if desired, could be a dual charge pump of the type described in copending application Ser. No. 274,881, filed June 18, 1981, now U.S. Pat. No. 4,367,670.

Returning now to FIG. 9, the phase locking system for the solo units and accompaniment units will be described. Phaselocking causes the dividers 395 (FIG. 13) of solo tone divider string 392 to all be set to the same states as the dividers in the solo unit to which it is locked and for the polycounter preset signals on lines 391 to occur at the same time for all of the solo units 116–120 which are phase locked to each other or for the accompaniment units 60–63, which are phase locked to each other, in the case of the accompaniment keyer block. The phase locking system comprises a Z transmitter having its Q1, Q2, Q3, Q4, Q5, Q6 and toggle (T) inputs 431 connected to the outputs 396 of the solo tone divider string 392 wherein the toggle input is the output of the highest divider 395 (FIG. 13). The Z transmitter is basically a parallel to serial converter which is clocked by the phase clock on line 432 and is enabled by the polycounter preset pulse on line 433. Z transmitter 430 is loaded with the seven outputs from the solo tone divider string 392 and, when enabled by the polycounter preset on line 433, shifts out through AND gate 434 onto the Z output line 435 the series of pulses illustrated in FIG. 17. This comprises a sync pulse 636 which is synchronized with the polycounter preset pulse 637, a space time slot 638, the seven output pulses 639 from solo tone divider string 392, and a stop pulse 640. AND gate 434 is enabled by the keydown signal on line 441 from the output of AND gate 442. This burst of pulses occurs each time that the polycounter preset pulse 637 occurs. The Z output line 435 for the solo unit in question is connected to the appropriate Z input line for the Z selector in each of the other four solo units. The Z selector **433*a* for solo units 116 is illustrated and has four inputs 434*a* from the Z outputs of the other four solo units 117, 118, 119 and 120. The output 435*a* from Z selector 433*a* carries the signal on the input 434*a* that is selected by the two bit binary select word on lines 436 from latches 345. It will be recalled that this binary code is generated by microcomputer 41** in accordance with its programming.

The Z receiver 360 comprises a phase clock input 437 carrying the same signal as input 432 for the Z transmitter 430, a lock enable signal 438 from latches 345, which is produced by microcomputer 41 as discussed earlier, and a keydown enable output 359, which is connected to keydown enable block 353 and produces a signal whenever phase locking is complete.

Z receiver 360 is shown in detail in FIG. 16 and will be seen to comprise a ten bit shift register 439 having as its input 440 the Z in signal selected by Z selector **433*a* (FIG. 9) in accordance with the programming of microcomputer 41, the phase clock input 437 and ten output lines 641. As the serial data is received on input 440 by shift register 439, it is clocked by the phase clocks on line 437 until the sync bit reaches the last stage therein. The output line 642 for the last stage of shift register 439 is connected through the delay circuit 443, which is clocked by a much higher frequency on clocking input 444 and serves to produce on clocking input 445 of ten bit latch 446 a delayed clocking signal. This latches the field shifted into ten bit shift register 439 onto the outputs 393 of latch 446**.

AND gate 447 has its inputs connected to the first and last stages of latch 446, which contain the stop and sync bits, respectively, so that if the field is correctly received and positioned within latch 446, AND gate 447 will place a 1 on the D input of flip-flop 448. The output on the last stage of shift register 439 is delayed further by delay circuit 449, and its output is connected by line 450 to the clear input of shift register 439, which clears shift register 439 so that it is ready to receive the next field. At the same time, the output of delay circuit 449 clocks shift register 448 so that a logic 1 appears on its outputs 451 and at one of the inputs of AND gate 452 if a valid field of data was received.

When the next field of data is properly received, the foregoing sequence of events occurs again and since the D input of flip-flop 453 now has a logic 1 on it, its Q output 454 will also go to a logic 1 when it is clocked thereby causing the output 455 of AND gate 452 to go to a logic 1, which logic level is placed on one of the inputs of AND gate 456.

The $\overline{\text{lock enable}}$ signal on line 438 is inverted by inverter 457 and also places a logic 1 on its input of AND gate 456. Flip-flop 458 has its D input 459 connected to the Z in line 435 by line 460 and is reset initially by the logic 0 on the output of AND gate 452 by virtue of inverter 461. Similarly, RS flip-flop 462 was reset by the inverted logic 0 on the output of AND gate 452 before the successful receipt of both fields. With lock enabled, however, and after the reception of two complete fields, the reset signals are taken off flip-flops 458 and 462. When the next polycounter preset pulse is received on the Z input 435 for the next field of phase locking pulses (FIG. 7), a logic 1 is placed on input 465 of AND gate 456 producing an output pulse on gate 456 output line 467 and a logic 1 on the D input 459 of flip-flop 458. One high frequency clock pulse later, flip-flop 458 is clocked thereby setting RS flip-flop 462 and placing a logic 0 on the inputs of AND gate 456 terminating the output pulse of AND gate 456. This polycounter preset pulse on line 467 is inverted by inverter **467*a* producing $\overline{ZS}$, which presets the polynomial counter 361 (FIG. 12) for this solo unit through NAND gate 386, inverter 387 and line 363. Thus, the polynomial counter 361 for this solo unit is locked in phase with the polynomial counter for the solo unit selected by Z selector 433*a* (FIG. 9). Depending on the programming of microcomputer 41**, if other solo units require phase locking, they can be locked to the solo unit just phase locked, and another solo unit can be locked to it, and so forth.

With the generation on line 467 of the synchronized polynomial preset signal, it is transmitted by line 469 through OR gate 470 to the reset input of flip-flop 471. The Q output of flip-flop 471 is connected to load line 394 of the solo tone divider string 392 (FIG. 13), and as discussed earlier, this causes the outputs 393 from Z receiver demultiplexer 360 to preset the stages of tone divider string 392. Thus, not only are the polynomial preset pulses for the phase locked tone units in synchronism, but the dividers 395 in the tone divider string 392 are set at the identical states so that perfect phase locking is achieved. At this point, depending on the programming of microcomputer 41, another solo unit could be locked to one of the two units already phase locked by initiating the sequence just discussed. The relationship between the polycounter clock, polycounter preset signal and tone signal when synchronized is illustrated in FIGS. 18A, 18B and 18C.

Figure 19:
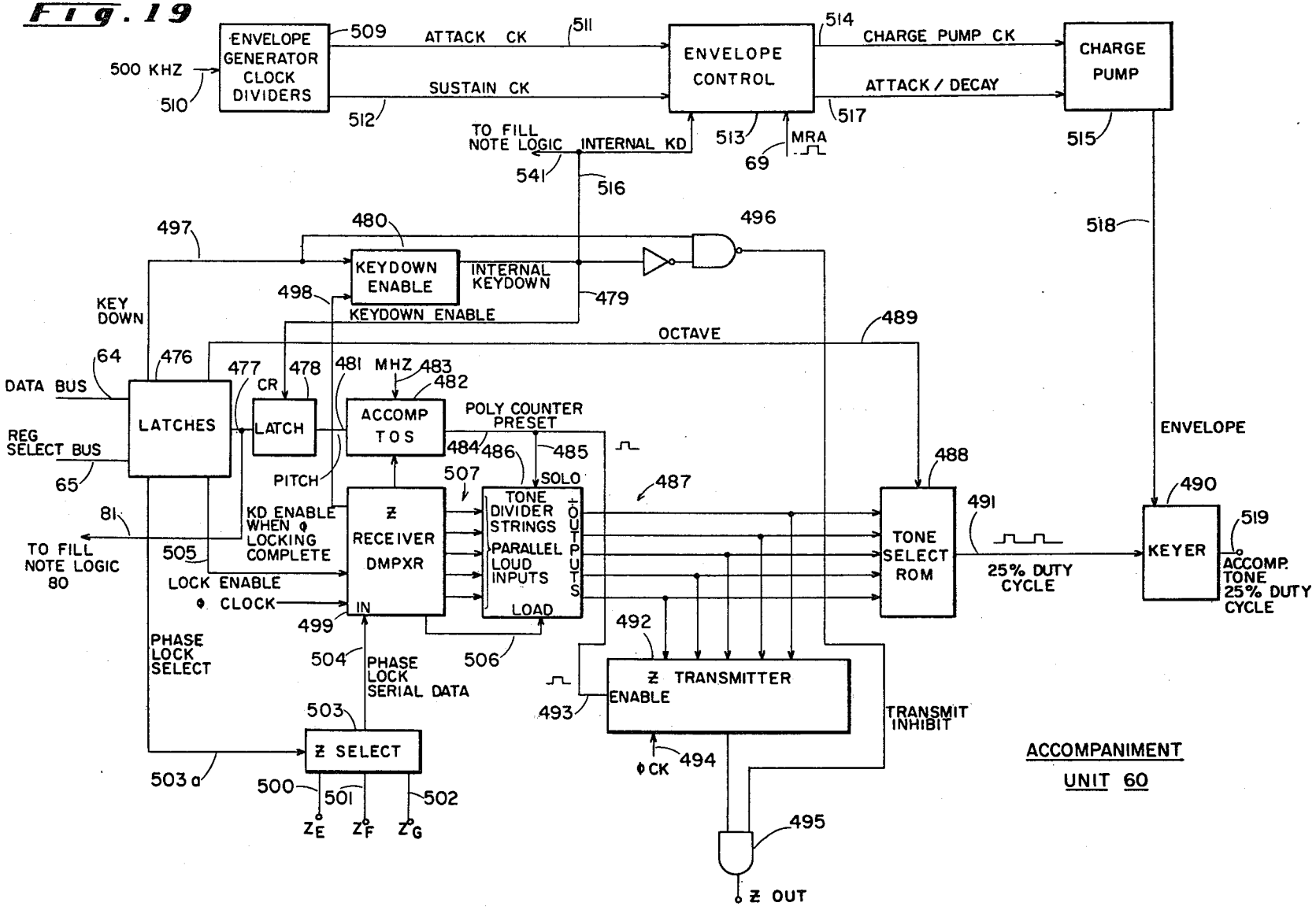
FIG. 19 is a block diagram of one of the accompaniment units shown in FIG. 1B.

FIG. 19 illustrates accompaniment unit 60, which is identical to the other accompaniment units 61, 62 and 63 shown in FIG. 1B. Accompaniment unit 60 is very similar in its makeup and operation to the solo unit 116 shown in FIGS. 9–17 and described in detail above.

Data bus 64 and register select bus 65 are connected to latches 476 having a four bit output 477 bearing the pitch information, which is latched in latch 478 by the keydown enable signal on line 479 from keydown enable block 480. The four bit pitch word on the output 481 of latch 476 is connected to the accompaniment top octave synthesizer 482 fed by a two megahertz signal on line 483 and producing a selected tone on output 484. Accompaniment top octave synthesizer 482 functions similarly to the solo top octave synthesizer 356 shown in detail in FIG. 12 and described above. The polycounter preset signal, which is the tone of selected pitch, is connected by line 485 to tone divider string 486, the latter being very similar to tone divider string 392 (FIG. 13) except that it has fewer stages. The outputs 487 of tone divider string 486 carrying five octaves of the selected pitch are connected to the inputs of tone select ROM 488, which selects one or more of the octavely related accompaniment tones in accordance with the two bit binary signal on control lines 489. Lines 489 are connected to latches 476 and carry the octave information as determined by the programming of microcomputer 41 and the key of accompaniment manual 31 which is depressed. The selected tone is connected to keyer 490 over line 491 and has a twenty-five percent duty cycle.

Phase locking of accompaniment units 60, 61, 62 and 63 is accomplished in the same manner as previously described in connection with the solo units 116–120. The outputs 487 of tone divider string 486 are connected to Z transmitter 492 having the polycounter preset signal connected thereto over line 493 and being clocked by the phase clocks in input line 494. The Z output signal is gated by AND gate 495 together with the transmit inhibit signal from NAND gate 496, which is developed by gating together in block 480 the keydown signal on line 497 from latches 476 and the keydown enable signal on line 498 from Z receiver 499, the latter being developed when phase locking is complete.

The Z output signals from the other three accompaniment units 61, 62 and 63 are connected by lines 500, 501 and 502 to Z selector circuit 503 having a two bit control input on lines 503 from latches 476 and an output 504 connected to Z receiver 499. Z receiver 499 is clocked by the same phase clocks as Z transmitter 492 and receives the lock enable signal on line 505 from latches 476. The load signal is connected to tone divider string 486 over line 506 and has five stage setting outputs 507 connected to the respective stages of tone divider string 486.

The envelope generation circuitry comprises envelope generator clock dividers 509 driven by a 500 KHz signal on input 510 and having an attack clock train on output 511 and a sustain clock output on line 512. Envelope control circuit 513 selects either the attack clock or sustain clock signals and outputs it on line 514 connected to charge pump 515. The keydown signal from keydown enable block 480 is connected to envelope control circuit 513 over line 516, and envelope control circuit 515 utilizes this signal to produce a logic 1 signal during attack and a logic 0 signal during decay on output 517 also connected to charge pump 515. If desired, envelope control circuit 513 can rhythmically pulse the accompaniment tone by producing on line 517 a pulse output at a rhythmic rate, which will then cause charge pump 515 to produce a series of amplitude envelopes. The pulsing output is timed in accordance with the musical rhythm accompaniment signal on line 69 from rhythm unit 94 (FIG. 1B). The output 518 from charge pump 515 carries the keying envelope, and is connected to FET keyer 490. The output 519 of keyer 490 is the accompaniment tone having a twenty-five percent duty cycle and an envelope developed in accordance with the output of charge pump 515.

Figures 20, 21:
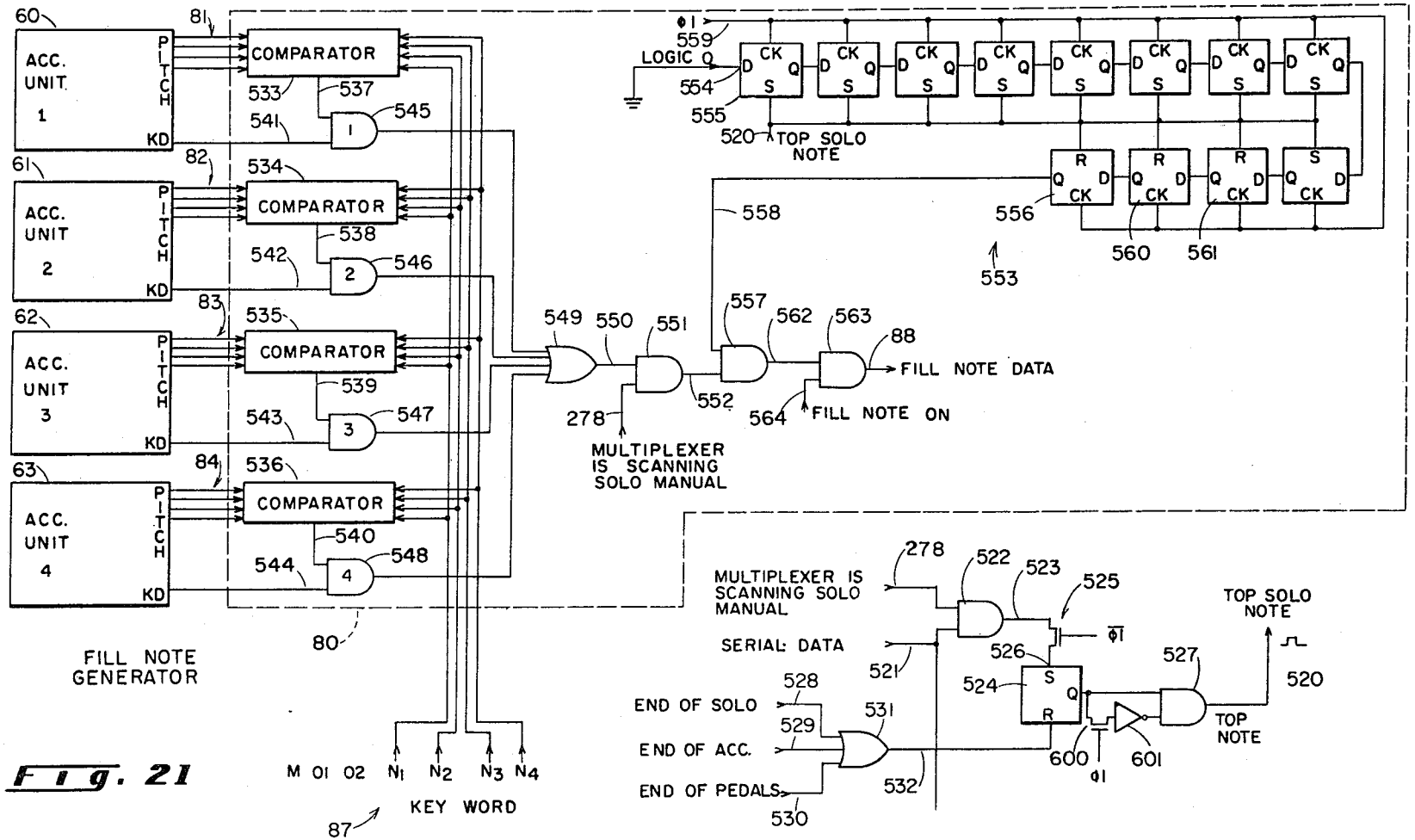
FIGS. 20, 21, and 22 are schematics of the fill note generator circuit.

FIGS. 20 and 21 illustrate the fill note generation circuitry of the organ. A pulse coinciding in time with the top solo note is generated on output line 510 (FIG. 20) by gating together the signal on line 278 from FIG. 3, which is present when multiplexer 33 is scanning the solo manual 32, and the serial data stream on line 521 from serial debouncer 39 (FIG. 7). AND gate 522 produces a logic 1 on its output 523 whenever a pulse appears in the data stream during the scanning of solo manual 32, and this pulse sets flip-flop 524 during phase one of the clock cycle due to the action of field effect transistor 525 connected in series between the set input 526 of flip-flop 524 and AND gate 522. AND gate 527 then puts a pulse on its output 520 for one half clock cycle through the action of phase 1 FET 600 and inverter 602. AND gates 522 and 527 and flip-flop 524 form a one shot for the first data pulse.

The end of solo scan pulse on line 528, the end of accompaniment scan pulse on line 529 and the end of pedal scan on line 530 from 104 bit shift register in FIG. 2 are gated together by OR gate 531 to produce three pulses on its output 532 coinciding with the end of the scan of the solo manual 32, the accompaniment manual 31 and pedalboard 30, respectively. These pulses are connected to the reset input of flip-flop 524 to ensure that flip-flop 524 is reset prior to the next scan of the manual. This ensures that the output of AND gate 527 will be a pulse coinciding with the highest note played on the solo manual as detected on each scan thereof. Since flip-flop 524 is not reset until after the solo manual 32 has been scanned, no further pulses will be produced, and the output pulse on 520 will be a single pulse for each scan coinciding with the highest depressed key on solo manual 32.

Referring now to FIG. 21, accompaniment keyer units 60, 61, 62 and 63 produce on their respective outputs 81, 82, 83 and 84 the four bit binary words representing the pitches being played by them. It will be recalled that the pitch information is developed by microcomputer 41 and connected to accompaniment units 60–63 through register control logic block 50 over data bus 64 (FIG. 1B). The four bit pitch word is taken off bus 64 and latched onto output lines 477 by the appropriate latch 476. This four bit word representing one of the twelve possible pitches for the tone is connected to fill note logic block 80 (FIG. 1A) over lines 81, 82, 83 and 84.

Fill note logic block 80 comprises four comparators 533, 534, 535 and 536 having one set of inputs connected to lines 81, 82, 83 and 84, respectively, and the other set of inputs connected to the N1, N2, N3 and N4 pitch lines 87 from the keyword ROM 190 in new keydown and release block 40 (FIG. 3). When a compare condition is reached by the respective comparator 533–536, which occurs when the pitch of the accompaniment unit 60–63 is the same as that currently being multiplexed by multiplexer 33, it produces on its respective output 537, 538, 539 or 540 a logic 1 pulse. This is ANDed together with the keydown pulses on lines 541, 542, 543 and 544 by AND gates 545, 546, 547 and 548, respectively, to produce serial data pulses at the inputs of OR gate 549.

Assuming that the performer is playing a C7 chord on the accompaniment manual, accompaniment units 60, 61, 62 and 63 will produce on outputs 81, 82, 83 and 84 the four bit binary words for the C, E, G and B flat pitches. When multiplexer 33 scans solo manual 32, it being recalled that the scanning is from high to low beginning with the solo manual, they will produce on outputs 537, 538, 539 and 540 pulses in the respective time slot for that pitch each time a key corresponding to that pitch is being scanned for each of manuals 30, 31, and 32, assuming that phase locking is complete as evidenced by keydown enable pulses on lines 541, 542, 543 and 544. These pulses will be summed by OR gate 549 to produce at the input 550 of AND gate 551 a serial data stream spanning the entire range of manuals 30, 31, and 32 and comprising pulses in time slots corresponding to each C, E, G and B flat key on manuals 30, 31 and 32. Since the other input 278 of AND gate 551 is a logic 1 only when multiplexer 33 is scanning solo manual 32, only those pulses corresponding to time slots in solo manual 32 will be gated to the output 552 of AND gate 551.

From a musical standpoint, it is desirable for the fill notes, which are those pitches played on the accompaniment manual, to be sounded only within the octave of the highest note played on the solo manual 32, and the fill notes should not occur too close to the highest note played on solor manual 32. Accordingly, it is necessay to form a "window" whereby the keydown pulses on line 552 are permitted to pass only within the octave immediately below the highest note played on solo manual 32 and not within the two time slots immediately below the highest note played. To form this window, a twelve bit shift register 553 is provided wherein the Q output of each stage is connected to the D input of the subsequent stage, wherein the D input 554 of the first stage 55 is connected to logic 0 and the Q output of the last stage 556 is connected to one of the inputs of AND gate 557 by line 558. Shift register 553 is clocked by the phase one clock signal on line 559. The top solo note output line 520 from AND gate 527 (FIG. 20) is connected to the set inputs of each of the stages of shift register 553 with the exception of the last three stages 556, 560 and 561 which have their reset inputs connected to line 520.

When the top solo note pulse appears on line 520, logic 1's are set into the first nine stages of shift register 553 and logic 0's into the last three stages thereof. This disables AND gate 557 for the time slot coinciding with the top solo note pulse on line 520 and for the next two time slots. At that time, however, the logic 1 states set into the first nine stages begin to enable AND gate 557 thereby permitting the serial data on line 552 to be passed to its output 562. This occurs for nine time slots until the logic 0 originally loaded into stage 555 reaches the Q output of the last stage 556, thereby disabling AND gate 557 at that time. AND gate 563 is enabled by the fill note on signal on line 564 from fill note on/off latch 86 (FIG. 1B), which is latched therein by the appropriate signals on buses 64 and 65 developed by microcomputer 41 through register control logic block 50. The fill note data, which is a multiplexed data stream synchronized with the scanning of solo manual 32 and occurring within a window nine time slots wide within the octave immediately below the highest note played on solo manual 32, is connected to one of the inputs of OR gate 34 (FIG. 1A) by line 88. OR gate 34 combines the fill note data stream with the serial data stream from multiplexer 33 so that the remainder of the system processes the fill note data in the same manner as if the data were played initially on the solo manual 32.

Figure 22:
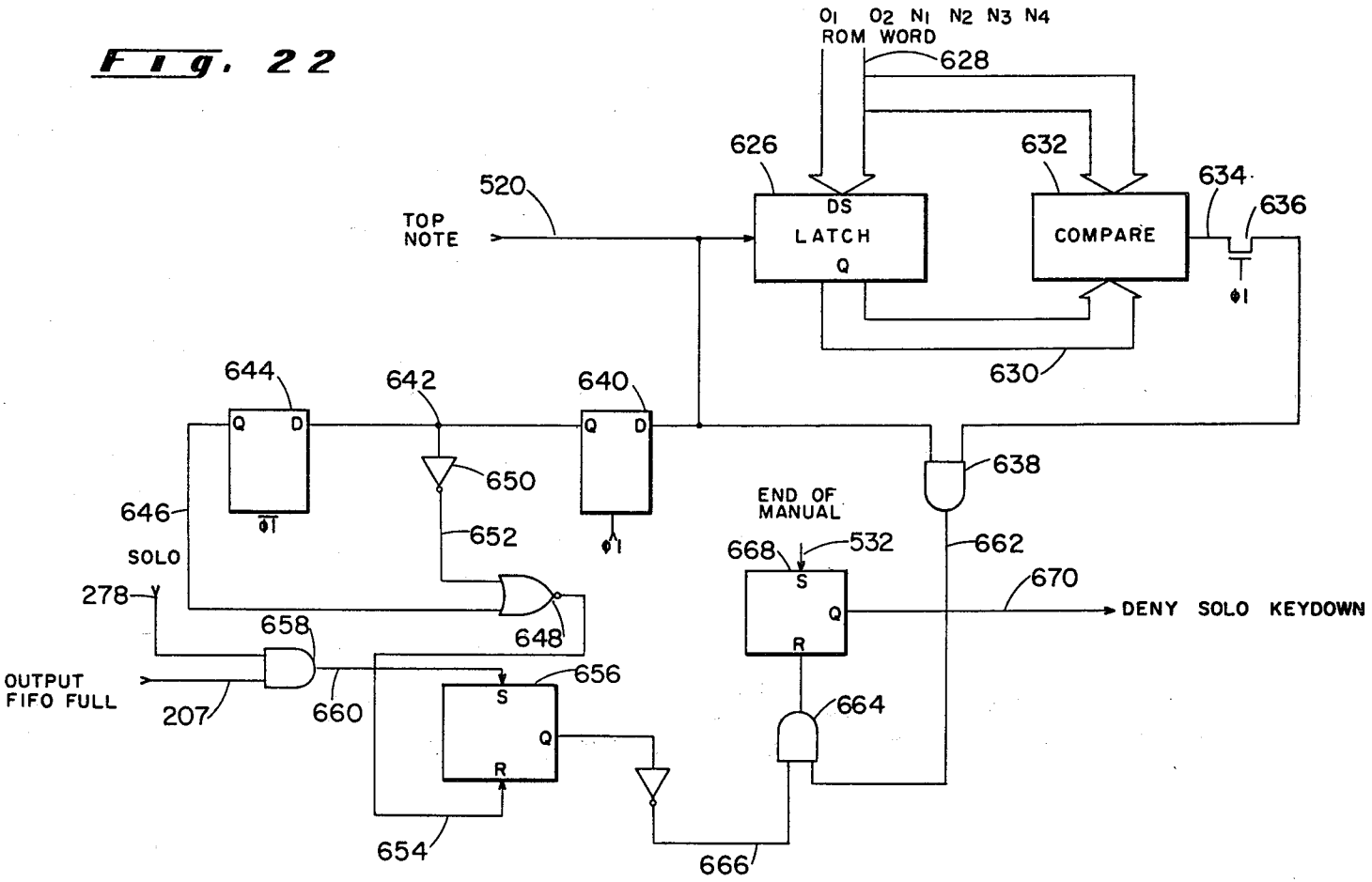

FIG. 22 discloses the circuit for enabling the transmission of solo keydown information to microcomputer 41 when produce on outputs 537, 538, 539 and 540 pulses in the respective time slot for that pitch each time a key corresponding to that pitch is being scanned for each of manuals 30, 31, and 32, assuming that phase locking is complete as evidenced by keydown enable pulses on lines 541, 542, 543 and 544. These pulses will be summed by OR gate 549 to produce at the input 550 of AND gate 551 a serial data stream spanning the entire range of manuals 30, 31, and 32 and comprising pulses in time slots corresponding to each C, E, G and B flat key on manuals 30, 31 and 32. Since the other input 278 of AND gate 551 is a logic 1 only when multiplexer 33 is scanning solo manual 32, only those pulses corresponding to time slots in solo manual 32 will be gated to the output 552 of AND gate 551.

From a musical standpoint, it is desirable for the fill notes, which are those pitches played on the accompaniment manual, to be sounded only within the octave of the highest note played on the solo manual 32, and the fill notes should not occur too close to the highest note played on solo manual 32. Accordingly, it is necessary to form a "window" whereby the keydown pulses on line 552 are permitted to pass only within the octave immediately below the highest note played on solo manual 32 and not within the two time slots immediately below the highest note played. To form this window, a twelve bit shift register 553 is provided wherein the Q output of each stage is connected to the D input of the subsequent stage, wherein the D input 554 of the first stage 555 is connected to logic 0 and the Q output of the last stage 556 is connected to one of the inputs of AND gate 557 by line 558. Shift register 553 is clocked by the phase one clock signal on line 559. The top solo note output line 520 from AND gate 527 (FIG. 20) is connected to the set inputs of each of the stages of shift register 553 with the exception of the last three stages 556, 560 and 561 which have their reset inputs connected to line 520.

When the top solo note pulse appears on line 520, logic 1's are set into the first nine stages of shift register 553 and logic 0's into the last three stages thereof. This disables AND gate 557 for the time slot coinciding with the top solo note pulse on line 520 and for the next two time slots. At that time, however, the logic 1 states set into the first nine stages begin to enable AND gate 557 thereby permitting the serial data on line 552 to be passed to its output 562. This occurs for nine time slots until the logic 0 originally loaded into stage 555 reaches the Q output of the last stage 556, thereby disabling AND gate 557 at that time. AND gate 563 is enabled by the fill note on signal on line 564 from fill note on/off latch 86 (FIG. 1B), which is latched therein by the appropriate signals on buses 64 and 65 developed by microcomputer 41 through register control logic block 50. The fill note data, which is a multiplexed data stream synchronized with the scanning of solo manual 32 and occurring within a window nine time slots wide within the octave immediately below the highest note played on solo manual 32, is connected to one of the inputs of OR gate 34 (FIG. 1A) by line 88. OR gate 34 combines the fill note data stream with the serial data stream from multiplexer 33 so that the remainder of the system processes the fill note date in the same manner as if the data were played initially on the solo manual 32.

FIG. 22 discloses the circuit for enabling the transmission of solo keydown information to microcomputer 41 when a new top key on the solo manual is depressed. The circuit produces a logic 1 on line 670 in FIG. 7 to activate AND gate 277. When the top solo note pulse appears on line 520, it also latches with latch 626 the O1, O2, N1, N2, N3 and N4 lines 628. Therefore, the output of latch 626 is a signal 630 which contains the binary word which represents the top note of the solo manual 32. Six bit binary comparator 632 outputs a logic 1 on signal 634 when the output of latch 626 and the keyboard ROM word 628 are at the same state. This signal 634 is gated through FET 636 and becomes an input to AND gate 638. Top note signal 520 is also input to shift register 640 which is clocked by phase one. The output 642 of shift register 640 is input to shift register 644 which is clocked by phase one. The output 646 of shift register 644 is an input to NOR gate 648. Signal 642 is also inverted by inverter 650 and this inverted signal 652 is input to NOR gate 648. The output 654 of NOR gate 648 is used to reset latch 656. This reset pulse 654 is basically a half-clock cycle pulse which occurs at the first phase one clock after a top note pulse 520. AND gate 658 has two inputs. One is solo signal 278, which is at logic 1 when the multiplexer 33 is scanning solo manual 32. The other input to AND gate 658 is the output FIFO full signal 207. The output 660 of AND gate 658 is used to set latch 656. Therefore, latch 656 is set if the output FIFO 42 becomes full while the multiplexer 33 is scanning solo manual 32. Latch 656 is reset after each top note pulse 520.

Another input to AND gate 638 is top note signal 520. The output 662 of AND gate 638 is at logic one when the top note on the present manual scan is the same as the top note of the previous manual scan. This signal 662 is an input to AND gate 664. Another input to AND gate 664 is signal 666, which is the inverted output of latch 656. The output of AND gate 664 is used to reset latch 668 and end of manual scan 532 is used to set latch 668. The output of latch 668 is deny solo keydown line 670 connected to AND gate 277 in FIG. 7.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. An electronic musical instrument comprising:

a keyboard having playing keys, a plurality of tone generator-keyer means each adapted for generating and keying a respective tone having a selectable frequency and a separate amplitude envelope, assignment control means connected to said tone generator-keyer means and responsive to the actuation of at least two keys of said keyboard for capturing at least two of said tone generator-keyer means and causing the captured tone generator-keyer means to generate respective tones, and phase locking means connected to said tone generator-keyer means for producing a synchronizing signal in response to the condition of one of the captured tone generator-keyer means producing a tone of the same pitch as the other captured tone generator-keyer means wherein the synchronizing signal represents the state of the phase of the tone generated by said one captured tone generator-keyer means and for transmitting the synchronizing signal to the other captured tone generator-keyer means, said other captured tone generator-keyer means including means responsive to said synchronizing signal for causing the tone generated thereby to be in phase with the tone generated by said one captured tone generator-keyer means.

2. The musical instrument of claim 1 wherein said assignment control means includes a microcomputer means electrically interposed between said keyboard and said tone generator-keyer means for recognizing available tone generator-keyer means and capturing the same in response to the actuation of keys of the keyboard, said microcomputer means further activating said phase locking means to cause phase locking between said captured tone generator-keyer means.

3. The musical instrument of claim 2 wherein said microcomputer means includes means for capturing at least three of said tone generator-keyer means and means for selecting to which of the captured tone generator-keyer means another of the captured tone generator-keyer means phase locks.

4. The musical instrument of claim 1 wherein each of said tone generator-keyer means comprises a polynomial counter clocked by a high frequency clocking signal, and said phase locking means resets the polynomial counter in synchronism with said synchronizing pulse.

5. The musical instrument of claim 1 wherein each of said tone generator-keyer means comprises a programmable divider means connected to a tone source for producing a plurality of octavely related tones, and said phase locking means comprises means for setting the divider means of said other tone generator-keyer means to the same state as the divider means of said one tone generator-keyer means.

6. The musical instrument of claim 5 wherein each of said tone generator-keyer means comprises a polynomial counter clocked by a high frequency clocking signal, and said phase locking means resets the polynomial counter in synchronism with said synchronizing pulse.

7. The musical instrument of claim 5 wherein each of said divider means comprises a plurality of stages, and said phase locking means comprises a parallel to serial convertor means associated with said one of the captured tone generator-keyer means for converting the states of the divider stages thereof into a serial data stream, means for transmitting the serial data stream to said other captured tone generator-keyer means, serial to parallel convertor means associated with said other tone generator-keyer means for converting the transmitted serial data stream to parallel data and setting the stages of the divider means in said other tone generator-keyer means in accordance with the parallel data.

8. The musical instrument of claim 7 wherein said phase locking means comprises a said parallel to serial convertor means for producing a serial data stream associated with each of said tone generator-keyer means and a said serial to parallel convertor means associated with each of said tone generator-keyer means, and selector means for selecting one of the serial data streams from one of the parallel to serial convertor means for transmission to the serial to parallel convertor means associated with a different tone generator-keyer means.

9. An electronic musical instrument comprising:

a keyboard having a plurality of playing keys, a plurality of tone generator-keyer means each adapted for generating and keying a respective tone having a selectable frequency and a separate amplitude envelope, assignment control means connected to said tone generator-keyer means and responsive to the actuation of at least one key of said keyboard for capturing at least two of said tone generator-keyer means and causing the captured tone generator-keyer means to generate at least two respective tones that are octavely related to each other, and phase locking means connected to said tone generator-keyer means for producing a synchronizing signal in response to the condition of one of the captured tone generator-keyer means wherein the synchronizing signal represents the state of the phase of the tone generated by said one captured tone generator-keyer means and for transmitting the synchronizing signal to the other captured tone generator-keyer means, said other captured tone generator-keyer means including means responsive to said synchronizing signal for causing the tone generated thereby to be in phase with the tone generated by said one captured tone generator-keyer means.

10. The musical instrument of claim 9 wherein each of said tone generator-keyer means comprises a polynomial counter clocked by a high frequency clocking signal, and said phase locking means resets the polynomial counter in synchronism with said synchronizing pulse.

11. The musical instrument of claim 9 wherein each of said tone generator-keyer means comprises a programmable divider means connected to a tone source for producing a plurality of octavely related tones, and said phase locking means comprises means for setting the divider means of said other tone generator-keyer means to the same state as the divider means of said one tone generator-keyer means.

12. The musical instrument of claim 11 wherein each of said divider means comprises a plurality of stages, and said phase locking means comprises a parallel to serial convertor means associated with said one of the captured tone generator-keyer means for converting the states of the divider stages thereof into a serial data stream, means for transmitting the serial data stream to said other captured tone generator-keyer means, serial to parallel convertor means associated with said other tone generator-keyer means for converting the transmitted serial data stream to parallel data and setting the stages of the divider means in said other tone generator-keyer means in accordance with the parallel data.

13. The musical instrument of claim 12 wherein said phase locking means comprises a said parallel to serial convertor means for producing a serial data stream associated with each of said tone generator-keyer means and a said serial to parallel convertor means associated with each of said tone generator-keyer means, and selector means for selecting one of the serial data streams from one of the parallel to serial convertor means for transmission to the serial to parallel convertor means associated with a different tone generator-keyer means.

14. An electronic musical instrument comprising:

a keyboard having playing keys, a plurality of tone generator-keyer means each adapted for generating and keying a respective tone having a selectable frequency and a separate amplitude envelope, said tone generator-keyer means each comprising a tone generator and a divider means connected to the tone generator for dividing the tone produced by the respective tone generator, the divider means having a plurality of stages each capable of assuming at least two states, assignment control means connected to said tone generator-keyer means and responsive to the actuation of at least one key of the keyboard for capturing at least two of said tone generator-keyer means and causing the captured tone generator-keyer means to generate respective tones, and phase locking means connected to said tone generator-keyer means for generating a synchronizing signal to control the tone generators of the captured tone generator-keyer means to generate the respective tones in phase with each other and to set the corresponding stages of the divider means of the captured tone generator-keyer means in the same states whenever the captured tone generator-keyer means are generating respective tones of the same or octavely related frequencies.

15. The musical instrument of claim 14 wherein the tones produced by the tone generator are square wave tones and said divider means stages produce respective tones that are octavely related to each other and to the tone generated by the tone generator connected thereto.

16. The musical instrument of claim 15 wherein each said tone generator-keyer means includes a tone select means connected to the stages of the respective divider means, said tone select means includes a control input and a tone input and means responsive to said control input to select at least one of the tones produced by the respective divider means and place the selected tone on the selector means output.

17. The musical instrument of claim 15 wherein:

each said tone generator comprises a programmable top octave synthesizer having a high frequency tone input, control input lines, and an output connected to the respective divider means, said assignment control means produces multiple bit pitch select words on the control input lines of the respective top octave synthesizer of the captured tone generator-keyer means in response to the actuation of keys of the keyboard to cause said top octave synthesizers to produce tones of corresponding pitches, the tone generator-keyer means each includes a tone select means connected to the stages of the respective divider means and having a controlled input and a tone output, and said assignment control means produces octave words on the control inputs of the tone select means of the captured tone generator-keyer means in response to the actuation of keys of the keyboard, and each said tone select means includes means responsive to the respective octave word on its control input to select one of the tones on the stages of the divider means connected thereto and place the selected tone on the output of the tone select means.

18. The musical instrument of claim 14 wherein said phase locking means includes means for producing a synchronizing signal in response to the condition of one of the captured tone generator-keyer means wherein the synchronizing signal bears a predetermined relation to the phase of the tone produced by said captured tone generator-keyer means and for transmitting the synchronizing signal to one of the other captured tone generator-keyer means, said other captured tone generator-keyer means including means responsive to said synchronizing signal for causing the tone generated thereby to be in phase with the tone generated by said one tone generator-keyer means.

19. The musical instrument of claim 18 wherein said phase locking means includes means for producing data representative of the states of the divider means stages of said one tone generator-keyer means and for transmitting said data to the divider means of said other tone generator-keyer means in synchronism with said synchronizing signal, the divider means of said other tone generator-keyer means including means for altering the states of its stages in accordance with said transmitted data whereby the corresponding stages of the divider means of said one and said other tone generator-keyer means are in the same states.

20. The musical instrument of claim 14 wherein said phase locking means includes a parallel to serial convertor means associated with one of the captured tone generator means for converting the states of the respective divider means stages into a serial data stream, means for transmitting the serial data stream to another of the captured tone generator-keyer means, and serial to parallel convertor means associated with said other tone generator-keyer means for converting the transmitted serial data stream to parallel data and setting the stages of the divider means in said other tone generator-keyer means in accordance with the parallel data.

21. The musical instrument of claim 20 wherein said phase locking means comprises a said parallel to serial convertor means for producing a serial data stream associated with each of said tone generator-keyer means and a said serial to parallel convertor means associated with each of said tone generator-keyer means, and selector means for selecting one of the serial data streams from one of the parallel to serial convertor means for transmission to the serial to parallel convertor means associated with a different tone generator-keyer means.

22. An electronic musical instrument comprising:

a keyboard having playing keys, a plurality of tone generator-keyer means each adapted for generating and keying a tone having a selectable frequency and a separate amplitude envelope, assignment control means connected to said tone generator-keyer means and responsive to the actuation of a plurality of keys of the keyboard for capturing at least three of said tone generator-keyer means and causing the captured tone generator-keyer means to generate respective tones, phase locking means connected to said tone generator-keyer means operable when said three tone generator-keyer means generate tones of the same or octavely related frequencies for producing a first synchronizing signal in response to a first one of a captured tone generator-keyer means wherein the first synchronizing signal represents the state of the phase of the tone generated by said first captured tone generator-keyer means and for transmitting the first synchronizing signal to a second one of the other captured tone generator-keyer means, said second captured tone generator-keyer means including means responsive to said first synchronizing signal for causing the tone generated thereby to be in phase with the tone generated by said first captured tone generator-keyer means, said phase locking means further including means for producing a second synchronizing signal in response to one of the first or second captured tone generator-keyer means wherein the second synchronizing signal represents the state of the phase of the tone generated by said one of the first or second captured tone generator-keyer means and for transmitting the second synchronizing signal to a third one of the captured tone generator-keyer means, said third tone generator-keyer means including means responsive to said second synchronizing signal for causing the tone generated thereby to be in phase with the tone generated by said one of the first or second tone generator-keyer means.

23. The musical instrument of claim 22 including microcomputer means connected to said phase locking means for selecting which of said first or second captured tone generator-keyer means said third tone generator means phase locks with.

24. The musical instrument of claim 22 wherein each of said tone generator-keyer means includes a programmable divider having a plurality of stages, and said phase locking means includes means for causing the corresponding stages of the divider means of said captured tone generator-keyer means to assume identical states.

25. The musical instrument of claim 9 wherein said phase locking means generates a plurality of said synchronizing signals at a rate determined by the frequency of the tone generated by said one captured tone generator-keyer means.

* * * * *